US007005223B2

(12) United States Patent
Yamashita et al.

(10) Patent No.: US 7,005,223 B2
(45) Date of Patent: Feb. 28, 2006

(54) TONER COMPOSITION AND METHOD FOR MANUFACTURING THE TONER COMPOSITION

(75) Inventors: Hiroshi Yamashita, Numazu (JP); Kazuhito Watanabe, Yokohama (JP); Chiaki Tanaka, Shizuoka-ken (JP); Tsunemi Sugiyama, Numazu (JP); Shigeru Emoto, Numazu (JP); Masami Tomita, Numazu (JP)

(73) Assignee: Ricoh Company Limited, Tokyo (JP)

( * ) Notice: Subject to any disclaimer, the term of this patent is extended or adjusted under 35 U.S.C. 154(b) by 0 days.

(21) Appl. No.: 10/092,920

(22) Filed: Mar. 8, 2002

(65) Prior Publication Data

US 2003/0077536 A1 Apr. 24, 2003

(30) Foreign Application Priority Data

Mar. 8, 2001 (JP) ..... 2001-065366
Mar. 26, 2001 (JP) ..... 2001-087924

(51) Int. Cl.
*G03G 9/097* (2006.01)

(52) U.S. Cl. ..... 430/108.3; 430/109.4; 430/110.3; 430/110.4; 430/111.41

(58) Field of Classification Search ..... 430/108.3, 430/109.4, 110.1, 110.2, 110.3, 110.4, 111.41, 430/108.1, 108.4
See application file for complete search history.

(56) References Cited

U.S. PATENT DOCUMENTS

| | | | | | |
|---|---|---|---|---|---|
| 2,520,827 | A | | 8/1950 | Beken | |
| 4,900,647 | A | | 2/1990 | Hikake et al. | |
| 5,176,978 | A | * | 1/1993 | Kumashiro et al. | 430/108.8 |
| 5,225,303 | A | | 7/1993 | Tomita et al. | |
| 5,244,765 | A | | 9/1993 | Katoh et al. | |
| 5,296,324 | A | | 3/1994 | Akagi et al. | |
| 5,350,657 | A | | 9/1994 | Anno et al. | |
| 5,368,972 | A | | 11/1994 | Yamashita et al. | |
| 5,501,935 | A | * | 3/1996 | Patel et al. | 430/137.14 |
| 5,547,802 | A | * | 8/1996 | Kawase et al. | 430/108.24 |
| 5,565,298 | A | | 10/1996 | Suguro et al. | |
| 5,721,083 | A | | 2/1998 | Masuda et al. | |
| 5,840,456 | A | | 11/1998 | Tomita et al. | |
| 5,851,716 | A | | 12/1998 | Kuramoto et al. | |
| 5,902,709 | A | * | 5/1999 | Nakayama et al. | 430/109.4 |
| 6,074,794 | A | | 6/2000 | Fushimi et al. | |
| 6,077,635 | A | * | 6/2000 | Okado et al. | 430/45 |
| 6,080,519 | A | * | 6/2000 | Ishiyama et al. | 430/110.3 |
| 6,103,441 | A | | 8/2000 | Tomita et al. | |
| 6,140,000 | A | * | 10/2000 | Yamashita | 430/108.2 |
| 6,221,549 | B1 | | 4/2001 | Emoto et al. | 430/120 |
| 6,255,028 | B1 | | 7/2001 | Hasegawa et al. | |
| 6,326,115 | B1 | * | 12/2001 | Nakanishi et al. | 430/109.5 |
| 6,329,115 | B1 | | 12/2001 | Yamashita | |
| 6,335,137 | B1 | | 1/2002 | Suzuki et al. | |
| 6,360,068 | B1 | | 3/2002 | Kinoshita et al. | |
| 6,363,229 | B1 | | 3/2002 | Shiraishi et al. | |
| 6,395,443 | B1 | | 5/2002 | Kuroda et al. | |
| 6,403,275 | B1 | | 6/2002 | Kuramoto et al. | |
| 6,432,589 | B1 | | 8/2002 | Uchinokura et al. | |
| 6,468,706 | B1 | | 10/2002 | Matsuda et al. | |
| 6,492,079 | B1 | | 12/2002 | Shimada et al. | |
| 6,544,705 | B1 | * | 4/2003 | Kim et al. | 430/109.4 |
| 2001/0010887 | A1 | * | 8/2001 | Sawano et al. | 430/108.3 |

FOREIGN PATENT DOCUMENTS

| | | |
|---|---|---|
| EP | 0 962 832 | 12/1999 |
| JP | 63-104064 | 5/1988 |
| JP | 63-244056 | 10/1988 |
| JP | 04-021862 | 1/1992 |
| JP | 05-119513 | 5/1993 |
| JP | 06-348055 | * 12/1994 |
| JP | 08-173783 | 7/1996 |
| JP | 09-127720 | 5/1997 |
| JP | 11-327199 | 11/1999 |
| JP | 2000-112180 | 4/2000 |

OTHER PUBLICATIONS

Japanese Patent Office Machine–Assisted Translation of JP 06–348055 (pub Dec. 1994).*
Japanesse Patent Office Machine–Assisted Translation of JP 2000–112180 (pub Apr. 2000).*
Thomson translation of JP 2000–112180–A (pub. Apr. 2000).*
USPTO Trademark Electronic Search System (TESS), Ser. No. 71178563, mark HANSA, updated on Nov. 13, 2004.*
USPTO Trademark Electronic Search Stystem (TESS), Ser. No. 72062272, mark Coulter Counter, updated on Nov. 13, 2004.*
USPTO Trademark Electronic Search System (TESS), Ser. No. 72453659, mark LITHOL, updated on Nov. 13, 2004.*
U.S. Appl. No. 10/244,526, filed Sep. 17, 2002, Pending, Originally Filed Claims and Abstract.
U.S. Appl. No. 10/666,254, filed Sep. 22, 2003, Kondo et al., Originally Filed Claims, Abstract and Drawings.
U.S. Appl. No. 10/712,026, filed Nov. 14, 2003, Tomita et al., Originally Filed Claims, Abstract and Drawings.
U.S. Appl. No. 10/725,402, filed Dec. 3, 2003, Shintani et al., Originally Filed Claims, Abstract and Figures.

(Continued)

*Primary Examiner*—Janis L. Dote
(74) *Attorney, Agent, or Firm*—Oblon, Spivak, McClelland, Maier & Neustadt, P.C.

(57) ABSTRACT

A toner composition including toner particles including a binder resin; and a colorant, and a charge controlling agent which is at least located on a surface of the toner particles, wherein the toner composition has a spherical degree of from 0.96 to 0.99, and wherein the toner composition satisfies the relationship: $10 \leqq M/T \leqq 1{,}000$ wherein M represents a quantity of an element on a surface of the toner particles in units of % by weight, wherein the element is included only in the charge controlling agent, and is one of elements of second to fifth periodical elements in the long form periodic table other than hydrogen, carbon, oxygen and rare gas elements; and T represents a quantity of the element in the toner composition in units of % by weight.

12 Claims, 7 Drawing Sheets

OTHER PUBLICATIONS

U.S. Appl. No. 10/729,960, filed Dec. 9, 2003, Tomita et al., Originally Filed Claims, Abstract, and Drawings.
U.S. Appl. No. 10/733,247, filed Dec. 12, 2003, Nanya et al., Originally Filed Claims, Abstract, and Drawings.
U.S. Appl. No. 10/026,743, filed Dec. 27, 2001, Pending, Originally Filed Claims, Abstract, and Drawings Only.
U.S. Appl. No. 09/826,789, filed Apr. 5, 2001, Unknown, Originally Filed Claims, Abstract, and Drawings Only.
U.S. Appl. No. 09/897,924, filed Jul. 5, 2001, Pending, Originally Filed Claims, Abstract, and Drawings Only.
U.S. Appl. No. 09/814,722, filed Mar. 23, 2001, Allowed, Originally Filed Claims, Abstract, and Drawings Only.
U.S. Appl. No. 10/193,216, filed Jul. 12, 2002, Pending, Originally Filed Claims, Abstract, and Drawings Only.
U.S. Appl. No. 10/247,639, filed Sep. 20, 2002, Pending, Originally Filed Claims, Abstract, and Drawings Only.
U.S. Appl. No. 10/607,014, filed Jun. 27, 2003, Tomita et al., Originally Filed Claims, Abstract, and Drawings.
U.S. Appl. No. 10/188,049, filed Jul. 3, 2002, Pending, Originally Filed Claims and Abstract.
U.S. Appl. No. 10/176,578, filed Jun. 24, 2002, Pending, Originally Filed Claims, Abstract and Drawings.
U.S. Appl. No. 10/188,753, filed Jul. 5, 2002, Pending, Originally Filed Claims, Abstract and Drawings.
U.S. Appl. No. 10/114,056, filed Apr. 3, 3003, Pending, Originally Filed Claims, Abstract and Drawings.
U.S. Appl. No. 10/158,069, filed May 31, 2002, Pending, Originally Filed Claims, Abstract and Drawings.
U.S. Appl. No. 10/151,103, filed May 21, 2002, Pending, Originally Filed Claims, Abstract and Drawings.
U.S. Appl. No. 10/077,752, filed Feb. 20, 2002, Pending, Originally Filed Claims, Abstract and Drawings.
U.S. Appl. No. 10/020,025, filed Dec. 19, 2001, Pending, Originally Filed Claims, Abstract and Drawings.
U.S. Appl. No. 09/964,622, filed Sep. 28, 2001, Pending.
U.S. Appl. No. 10/101,756, filed Mar. 21, 2002, Pending, Originally Filed Claims, Abstract and Drawings.
U.S. Appl. No. 10/077,813, filed Feb. 20, 2002, Pending, Originally Filed Claims, Abstract and Drawings.
U.S. Appl. No. 10/059,240, filed Jan. 31, 2002, Pending, Originally Filed Claims, Abstract and Drawings.
U.S. Appl. No. 10/079,878, filed Feb. 22, 2002, Pending, Originally Filed Claims, Abstract and Drawaings.
U.S. Appl. No. 09/905,872, filed Jul. 17, 2001, Pending, Originally Filed Claims, Abstract and Drawings.
U.S. Appl. No. 09/988,142, filed Nov. 19, 2001, Pending, Originally Filed Claims, Abstract and Drawings.
U.S. Appl. No. 09/993,606, filed Nov. 27, 2001, Pending, Originally Filed Claims, Abstract and Drawings.
U.S. Appl. No. 09/996,585, filed Nov. 30, 2001, Pending, Originally Filed Claims, Abstract and Drawings.
U.S. Appl. No. 09/982,877, filed Oct. 22, 2001, Pending, Originally Filed Claims, Abstract and Drawings.
U.S. Appl. No. 09/965,826, filed Oct. 1, 2001, Pending, Originally Filed Claims, Abstract and Drawings.
U.S. Appl. No. 10/284,177, filed Oct. 31, 2002, Pending, Originally Filed Claims, Abstract and Drawings.
U.S. Appl. No. 10/112,769, filed Apr. 2, 2002, Pending, Originally Filed Claims, Abstract and Drawings.
U.S. Appl. No. 10/098,556, filed Mar. 18, 2002, Pending, Originally Filed Claims, Abstract and Drawings.
U.S. Appl. No. 09/867,557, filed May 30, 2001, Per Client.
U.S. Appl. No. 09/661,444, filed Sep. 13, 2000, Allowed, Originally Filed Claims and Abstract.
U.S. Appl. No. 09/567,982, filed May 10, 2000, Allowed, Originally Filed Claims and Abstract.
U.S. Appl. No. 09/384,797, filed Aug. 27, 1999, Per Client, Originally Filed Claims, Abstract and Drawing.
U.S. Appl. No. 10/246,601, filed Sep. 19, 2002, Pending, Originally Filed Claims, Abstract and Drawing.
U.S. Appl. No. 09/986,023, filed Nov. 7, 2001, Pending, Originally Filed Claims and Abstract.
U.S. Appl. No. 09/843,357, filed Apr. 26, 2001, Unknown, Originally Filed Claims, Abstract and Drawings.
U.S. Appl. No. 09/891,652, filed Jun. 26, 2001, Unknown, Originally Filed Claims, Abstract and Drawings.
U.S. Appl. No. 09/862,436, filed May 23, 2001, Pending.
U.S. Appl. No. 09/667,717, filed Sep. 22, 2000, Unknown.
U.S. Appl. No. 09/643,910, filed Aug. 23, 2000, Unknown, Originally Filed Claims, Drawings and Abstract.
U.S. Appl. No. 09/712,927, filed Nov. 16, 2000, Unknown, Originally Filed Claims, Drawings and Abstract.
U.S. Appl. No. 09/725,276, filed Nov. 29, 2000, Allowed, Originally Filed Claims and Abstract.
U.S. Appl. No. 09/653,452, filed Aug. 31, 2000, Allowed, Originally Filed Claims, Abstract and Drawings.
U.S. Appl. No. 09/523,700, filed Mar. 13, 2000, Pending, Originally Filed Claims, Abstract and Drawings.
U.S. Appl. No. 10/724,150, filed Dec. 1, 2003, Tomita et al., Originally Filed Claims, Abstract, Drawings.
U.S. Appl. No. 10/707,000, filed Nov. 14, 2003, Tomita et al., Originally Filed Claims, Abstract, Drawings.
U.S. Appl. No. 10/706,113, filed Nov. 13, 2003, Tanaka et al., Originally Filed Claims, Abstract, Drawings.
U.S. Appl. No. 10/724,260, filed Dec. 1, 2003, Emoto et al., Originally Filed Claims, Abstract, Drawings.
U.S. Appl. No. 10/286,791, filed Nov. 4, 2002, Pending, Originally Filed Claims and Abstract.
U.S. Appl. No. 10/394,265, filed Mar. 24, 2003, Nanya et al., Originally Filed Claims and Abstract.
U.S. Appl. No. 10/392,894, filed Mar. 21, 2003, Yamashita, Originally Filed Claims, Abstract and Drawings.
U.S. Appl. No. 10/623,522, filed Jul. 22, 2003, Yamashita et al., Originally Filed Claims and Abstract.
U.S. Appl. No. 10/674,358, filed Oct. 1, 2003, Sugiyama et al., Originally Filed Claims, Abstract, and Figures.
U.S. Appl. No. 10/670,320, filed Sep. 26, 2003, Watanabe et al., Originally Filed Claims, Abstract, and Figures.
U.S. Appl. No. 10/652,505, filed Sep. 2, 2003, Murakami et al., Originally Filed Claims, Abstract, and Figures.
U.S. Appl. No. 10/645,804, filed Aug. 22, 2003, Tomita et al., Originally Filed Claims, Abstract, and Drawings.
U.S. Appl. No. 10/793,320, filed Mar. 5, 2004, Higuchi et al., Originally Filed Claims, Abstract, and Drawings.
U.S. Appl. No. 10/759,197, filed Jan. 20, 2004, Emoto et al., Originally Filed Claims, Abstract, and Drawings.
U.S. Appl. No. 10/760,452, filed Jan. 21, 2004, Higuchi et al., Originally Filed Claims, Abstract, and Drawings.
U.S. Appl. No. 10/769,855, filed Feb. 3, 3004, Watanabe et al., Originally Filed Claims, Abstract, and Figures.
U.S. Appl. No. 10/804,082, filed Mar. 19, 2004, Tanaka et al., Originally Filed Claims, Abstract and Drawings Only.
U.S. Appl. No. 10/802,887, filed Mar. 18, 2004, Tanaka et al., Originally Filed Claims and Abstract Only.

U.S. Appl. No. 10/802,866, filed Mar. 18, 2004, Saito et al., Originally Filed Claims and Abstract Only.
U.S. Appl. No. 10/820,726, filed Apr. 9, 2004, Koike et al., Originally Filed Claims, Abstract and Drawings.
U.S. Appl. No. 10/804,084, filed Mar. 19, 2004, Takada et al., Originally Filed Claims, Abstract, and Drawings.
U.S. Appl. No. 10/843,574, filed May 12, 2004, Yanagida et al., Originally Filed Claims and Abstract.
U.S. Appl. No. 10/871,580, Jun. 21, 2004, Ohtani et al.
U.S. Appl. No. 10/872,640, filed Jun. 22, 2004, Matsuoka et al.
U.S. Appl. No. 10/876,718, filed Jun. 28, 2004, Sugiyama et al.
U.S. Appl. 10/874,269, filed Jun. 24, 2004, Murakami et al.
U.S. Appl. No. 10/910,764, filed Aug. 4, 2004, Inoue et al.
U.S. Appl. No. 10/921,923, filed Aug. 20, 2004, Koike et al.
U.S. Appl. No. 10/921,993, filed Aug. 20, 2004, Amemiya et al.
U.S. Appl. No. 10/960,084, filed Oct. 8, 2004, Yamada et al.
U.S. Appl. No. 10/957,629, filed Oct. 5, 2004, Watanabe et al.
U.S. Appl. No. 11/016,964, filed Dec. 21, 2004, Ohki, et al.

* cited by examiner

TONER COMPOSITION AND METHOD FOR MANUFACTURING THE TONER COMPOSITION

BACKGROUND OF THE INVENTION

1. Field of the Invention

The present invention relates to a toner for use in a developer developing an electrostatic latent image formed by electrophotography, electrostatic recording, electrostatic printing, etc., and to a method for manufacturing the toner. More particularly, the present invention relates to an electrophotographic toner for use in copiers, laser printers, plain paper facsimile machines, etc., and to a method for manufacturing the toner. In addition, the present invention also relates to a color toner for use in full color copiers, full color laser printers, full color facsimile machines, which use a direct or indirect electrophotographic developing method, and to a method for manufacturing the color toner.

2. Discussion of the Background

An electrostatic latent image formed on an image bearing member, for example, by electrophotography, electrostatic recording, electroprinting or the like method is developed with a developer to form a visible image (i.e., a toner image) on the image bearing member (developing process). The toner image is then transferred onto a receiving material such as receiving paper optionally via an intermediate transfer medium (transfer process). The toner image on a receiving material is then fixed on the receiving material (fixing process).

As the developer, two-component developers consisting of a carrier and a toner and one-component developers which do not include a carrier and which consists of a magnetic or non-magnetic toner are well known. In a two-component developer, the toner is frictionally charged, for example, by contacting the carrier. In a one-component developer, the toner is frictionally charged by contacting a roller supplying the toner to a developing sleeve, a blade regulating the toner to form a toner layer on the developing sleeve and/or the like member.

In order to prepare a toner image faithfully reproducing an electrostatic latent image, the charge properties of the toner have to be properly controlled. Therefore, various charge controlling agents and methods adding the charge controlling agents have been proposed. In particular, charge controlling agents are generally expensive. In addition, a charge controlling agent effectively functions when being present at a surface of a toner. Therefore, in order to reduce manufacturing costs, it is attempted to include a small amount of a charge controlling agent on a surface or in a surface portion of toner particles.

Japanese Laid-Open Patent Publications Nos. (hereinafter referred to as JOPs) 63-104064, 05-119513, 09-127720 and 11-327199 have disclosed toners in which a charge controlling agent is adhered to the surface of the toner particles to impart a charge to the toners. However, the toners are not fully charged. In addition, a problem which occurs is that the charge controlling agent tends to be easily released from the surface of the toners. Further, the proposed methods of manufacturing the toners do not provide toners having good charging ability.

Currently, methods for manufacturing a toner such as polymerization methods, other than pulverizing methods, have been investigated. Such polymerization methods are suitable for producing toners having a relatively spherical form, a small particle diameter and a narrow particle diameter distribution. The thus prepared toners, which have a relatively spherical form and a small particle diameter, have weak attraction for image bearing members such as photoreceptors and intermediate transfer media. Therefore, toner images formed by such a toner can be transferred at a high transfer rate, and high resolution images can be formed. In addition, such a toner is hardly pulverized excessively by contact with carriers and various elements such as developing blades and cleaning blades in image forming apparatus. Therefore, such a toner can maintain its particle diameter even when used for a long period of time. The quantity of a charge controlling agent present on the surface or in the surface portion of toner particles is very important factor for such toners having a relatively spherical form and a small diameter.

JOPs 04-21862 and 2000-112180 have disclosed techniques in which a toner having a proper charge quantity and a proper charging speed is prepared by controlling the quantities of a charge controlling agent present on the surface and inside of the toner particles. These techniques are inefficient.

JOP 04-21862 specifies the ratio of the particles of a charge controlling agent present on the surface of the toner. According to the surface analysis method disclosed in JOP 04-21862, the ratio of the number of the elements present on the surface of the toner can be determined. However, the ratio of the number of molecules of the charge controlling agent at the surface of the toner particles cannot be determined because the materials present on the surface of the toner particles are not known. Even if the molecular structures of the materials present on the surface of the toner are known, the ratio of the number of the molecules of the charge controlling agent at the surface of the toner particles cannot be determined. In addition, the effect of the toner form to the charge properties of the toner is not considered in JOPs 04-21862 and 2000-112180.

JOP 2000-112180 specifies the concentration of the charge controlling agent on the surface of the toner particles and the concentration thereof in the whole toner particles. However, it is not attempted to positively arrange a charge controlling agent on the surface of toner particles, and therefore, the ratio of the concentration of the charge controlling agent on the surface of the toner particles to the concentration thereof in the whole toner particles is less than 10. Therefore, the charge rising property of the toner is not satisfactory. In addition, since a charge controlling agent is included in the inside of the toner particles, the toner has an unsatisfactory fixability and transparency.

With respect to the method of adhering a charge controlling agent, which is typically expensive, on the surface of toner particles (i.e., mother toner particles), JOP 63-244056 discloses a method in which a charge controlling agent is adhered and fixed on the surface of mother toner particles utilizing an impulse force generated at a gap between a rotor (i.e., a blade rotated at a high speed) and a stator (i.e., projections fixed on the inside wall of a vessel). However, since the inside wall has projections, crosscurrent tends to be formed, and thereby problems such that the particles are excessively pulverized, or the particles are partially melted tend to occur, resulting in performance of uneven treatment.

When the mixture is treated at such a narrow gap, a large amount of heat is induced due to impulse force at the gap, and thereby the toner particles tend to be deformed and/or are excessively pulverized. Therefore a problem such that the resultant toner has an undesired average particle diameter and/or an undesired particle diameter distribution tends to occur. In addition, a problem such that a charge controlling agent is embedded into mother toner particles and the resultant toner cannot exert the desired performance. Further, in order to prevent such problems, the processability of the mixer deteriorates because processing is performed while preventing such problems, and therefore the manufacturing method is not efficient.

JOP 08-173783 discloses a mixer as shown in FIG. 8, which has a spherical vessel 101, a driving shaft 105 arranged so as to pass through the center of a circular bottom 102 of the vessel 101, a boss 103 having a cone form and provided on the driving shaft 105, and an agitating blade 104 provided on the periphery of the boss and configured to scatter mixture particles to be treated toward the inside wall of the vessel 101. However, the mixer has a drawback in that when the rotating speed of the mixture particles to be treated approaches the rotation speed of the agitating blade, the shear stress applied to the mixture particles decreases and thereby uniform mixing such that the additive is adhered on the mother toner particles while the mother toner particles and additive are separated into their primary particles cannot be performed (hereinafter this problem is referred to as a shear stress decreasing problem).

In addition, this mixer has a function of generating circling air flow upwardly along the inside wall of the vessel to circle the mixture to be treated, but the mixer does not have a function of returning the air flow downwardly. Therefore air turbulence is generated and the mixture scattered upwardly cannot be returned to the agitating blade. Namely, a self cleaning operation is not performed by the mixture and thereby a mixture deposition problem such that the mixture tends to be deposited on the inside wall of the vessel tends to occur.

Further, when mother toner particles and a charge controlling agent (and/or a fluidity imparting agent) are mixed in a mixer, the rotating shaft is heated and therefore shaft sealing air is typically applied to the shaft to prevent deposition of the mixture on the rotating shaft. Therefore the supplied air need to be discharged from the vessel. JOP 08-173783 discloses an air discharging mechanism 106 as shown in FIG. 8 which is configured to discharge air from the vessel 101 through a filer. If the filter does not has a large area, the filter is rapidly choked with the mixture particles. Thereby air cannot be fully supplied to the rotating shaft 105, resulting in deposition of the mixture particles on the rotating shaft 105. In attempting to solve this problem, the discharging mechanism 106 is large in size and is typically projected upwardly. The mixture particles moving upwardly along the inside wall of the vessel 101 are moved toward the discharging mechanism 106, resulting in adhesion of the mixture particles on the filter of the discharging mechanism 106. Therefore uniform mixing cannot be performed, and the resultant toner has a poor charge rising property. In addition, a problem in that the mixture particles adhered on the filter fall and deposit on the vessel tends to occur.

Because of these reasons, a need exists for a toner which has a relatively spherical form and a small particle diameter and which has uniform charge properties and good charge rising property so as to produce high quality images even when used for a long period of time for image forming apparatus. In addition, a need exists for a method for efficiently manufacturing such a toner without causing toner deposition problem and shearing stress decreasing problem.

SUMMARY OF THE INVENTION

Accordingly, an object of the present invention is to provide a toner having the following advantages:

(1) having a high transferability and being capable of producing high resolution images and;

(2) having a high charge rising property when the toner is contacted with a carrier, a developing sleeve or the like members even though the toner has a relatively spherical form, a relatively small particle diameter, and a relatively narrow particle diameter distribution; and (3) having uniform charge properties and being capable of producing high quality images for a long period of time without being deformed and/or excessively pulverized.

Another object of the present invention is to provide a toner having a good combination of low-temperature fixability, high transparency and wide fixable temperature range.

Yet another object of the present invention is to provide a toner which is manufactured by a method using an aqueous solvent and which has a high charge rising property and uniform charge properties and is hardly deformed and/or excessively pulverized even when used for a long period of time.

A further object of the present invention is to provide a method of uniformly adhering a charge controlling agent on a surface of toner particles.

A still further object of the present invention is to provide a method of efficiently manufacturing the toner mentioned above without causing toner deposition problem and shearing stress decreasing problem.

A still further object of the present invention is to provide a full color image forming method using the toner mentioned above.

Briefly these objects and other objects of the present invention as hereinafter will become more readily apparent can be attained by a toner composition including toner particles including a binder resin and a colorant, and a charge controlling agent which is at least located on a surface of the toner particles, wherein the toner composition has a spherical degree of from 0.96 to 0.99, and wherein the toner composition satisfies the relationship: $10 \leqq M/T \leqq 1,000$ wherein M represents a quantity of an element present on a surface or in a surface portion of the toner particles in units of % by weight which is determined by a XPS (X-ray photoelectron microscopy) method, wherein the element is included only in the charge controlling agent and is not included in other toner constituents, and is one of elements of from second to fifth periodical elements (i.e., elements of from "Li" to "I") in the long form periodic table other than carbon, oxygen and rare gas elements; and T represents a quantity of the element included in the toner composition in units of % by weight.

The element present on a surface or in a surface portion of the toner particles is sometimes referred to as "the element present on the surface of the toner particles".

The spherical degree is preferably from 0.975 to 0.985 to produce high quality images. When the spherical degree is too small, the thickness of the toner layer formed on a developing sleeve becomes too thin. In contrast, when the spherical degree is too large, the toner layer thickens, resulting in performance of excessive development.

The M/T ratio is preferably from 100 to 800 to impart good charge properties to the toner and to avoid contamination of image forming members contacting the toner.

The charge controlling agent which is present on the surface of the toner composition is not preferably included inside of the toner particles because good charge properties can be imparted to the toner composition having the specified spherical degree. Such a toner is particularly useful as a color toner.

The toner composition preferably satisfies the following relationship:

$$0.7 \leqq (Q/M1)/(Q/M2) \leqq 1.3$$

wherein Q/M1 represents a charge quantity of the toner composition in units of $\mu$C/g when the toner composition is mixed with a carrier coated with a silicone resin for 15 seconds and Q/M2 represents a charge quantity of the toner composition in units of $\mu$C/g when the toner composition is mixed with the carrier for 600 seconds.

In addition, the toner composition preferably has a volume average particle diameter (Dv) of from 2 $\mu$m to 8 $\mu$m and a number average particle diameter (Dn), wherein a ratio Dv/Dn is not greater than 1.2.

The charge controlling agent is preferably included in the toner composition in an amount of from 0.01% to 2.0% by weight based on the weight of the toner particles.

The charge controlling agent is preferably selected from the group consisting of metal complexes of salicylic acid and its derivatives and metal salts of salicylic acid and its derivatives.

The toner particles preferably include a wax, wherein the wax is dispersed in the toner particles while having an average dispersion diameter not greater than 2.0 $\mu$m and preferably from 0.2 $\mu$m to 2.0 $\mu$m to impart good fluidity, color reproducibility and gloss to the toner and to prevent a filming problem.

The binder resin preferably includes a polyester resin in a largest amount. The soluble components of the binder resin has a molecular weight distribution such that a peak is observed in a range of from 1,000 to 30,000, preferably from 1,500 to 10,000 and more preferably from 2,000 to 8,000, to impart good preservation property and low temperature fixability. In addition, the binder resin has a fraction having a molecular weight not less than 30,000 in an amount of from 1% to 10% and more preferably from 3% to 6% by weight to prepare a color toner having good color toner and releasability. In addition, the resultant toner has good offset resistance and the resultant images have good gloss and transparency.

The binder resin preferably has a Mv/Mn ratio not greater than 5 such that the resultant toner sharply melts and the resultant images have high gloss.

In another aspect of the present invention, a method for manufacturing a toner composition is provided which includes:

preparing toner particles including a binder resin and a colorant; and mixing the toner particles with a charge controlling agent using a mixer having a rotor to form the toner composition, wherein the toner composition has a spherical degree of from 0.96 to 0.99, and wherein the toner composition satisfies the following relationship:

$$10 \leqq M/T \leqq 1{,}000$$

wherein M represents a quantity of an element present on a surface of the toner particles in units of % by weight, wherein the element is included only in the charge controlling agent but is not included in other constituents of the toner composition, and is one of elements of from second to fifth periodical elements in the long form periodic table other than hydrogen, carbon, oxygen and rare gas elements; and T represents a quantity of the element included in the toner composition in units of % by weight.

The mixer preferably has a vessel configured to contain the toner particles and the charge controlling agent; a driving shaft arranged so as to substantially vertically pass through a bottom of the vessel and configured to rotate the rotor, wherein the rotor is provided on the driving shaft and rotates substantially parallel to the bottom of the vessel; and a cylindrical member located at a position in an extension direction of the driving shaft.

The vessel preferably has a spherical form and the bottom of the vessel has a flat circular form, and wherein the driving shaft passes through a substantially center of the flat circular bottom of the vessel.

The mixer preferably satisfies the following relationship:

$$L \geqq H/10$$

wherein H represents an inside height of the vessel and L represents an inside length of the cylindrical member in the vessel.

The mixer preferably satisfies the following relationship:

$$R2 \geqq R1/10$$

wherein R1 represents an inside width of the vessel and R2 represents an inside diameter of the cylindrical member.

In addition, the cylindrical member has a tip having a trumpet form.

In the mixing step, the rotor is preferably rotated at a rotation speed of from 40 m/s to 150 m/s.

The mixing step preferably has a premixing step in which the toner particles are mixed with the charge controlling agent while rotating the rotor at a rotation speed lower than 50 m/s. In this case, the following mixing step is preferably performed at a rotation speed not lower than 50 m/s.

The toner composition may further include an external additive, wherein the external additive is mixed with the toner particles and the charge controlling agent in the mixing step.

The toner particles preparing step is preferably performed by one of the following methods:

a method including:

kneading the binder resin and the colorant upon application of heat to prepare a mixture;

pulverizing the mixture to prepare a powdery mixture;

classifying the powdery mixture to prepare raw toner particles; and applying at least one of heat and mechanical impulse force to the raw toner particles to prepare the toner particles, wherein the toner particles have a spherical degree of from 0.96 to 0.99;

a method including:

suspension-polymerizing one or more monomers, which optionally includes the colorant, in an aqueous liquid to prepare the toner particles;

a method including:

dissolving the binder resin in an organic solvent to prepare a solution of the binder resin;

dispersing the solution and the colorant in an aqueous liquid to prepare a dispersion of the binder resin and the colorant; and drying the dispersion of the binder resin and the colorant to prepare the toner particles.

a method including:

dispersing the binder resin in an organic solvent to prepare an organic solvent dispersion of the binder resin;

dispersing the organic solvent dispersion and the colorant in an aqueous liquid to prepare an aqueous dispersion of the binder resin and the colorant; and drying the aqueous dispersion to prepare the toner particles.

a method including:

reacting a prepolymer with a compound in an organic solvent to prepare a solution of the binder resin;

dispersing the solution and colorant in an aqueous liquid to prepare an aqueous dispersion of the binder resin and the colorant; and drying the aqueous dispersion to prepare the toner particles;

a method including:

reacting a prepolymer with a compound in an organic solvent to prepare an organic solvent dispersion of the binder resin;

dispersing the organic solvent dispersion and the colorant in an aqueous liquid to prepare an aqueous dispersion of the binder resin and the colorant; and drying the aqueous dispersion to prepare the toner particles; and a method including:

reacting a prepolymer with a compound in an aqueous liquid including the colorant to prepare an aqueous dispersion of the binder resin and the colorant; and drying the aqueous dispersion to prepare the toner particles.

Among these methods, a method is preferable in which toner particles are prepared by dissolving or dispersing toner constituents including a polyester resin in an organic solvent or a monomer, dispersing the solution or dispersion in an aqueous liquid and drying the aqueous dispersion after optionally performing a reaction. The polyester resin preferably has a urea bonding.

These and other objects, features and advantages of the present invention will become apparent upon consideration of the following description of the preferred embodiments of the present invention taken in conjunction with the accompanying drawings.

BRIEF DESCRIPTION OF THE DRAWINGS

Various other objects, features and attendant advantages of the present invention will be more fully appreciated as the same becomes better understood from the detailed description when considered in connection with the accompanying drawings in which like reference characters designate like corresponding parts throughout and wherein.

DETAILED DESCRIPTION OF THE INVENTION

Figure 1:
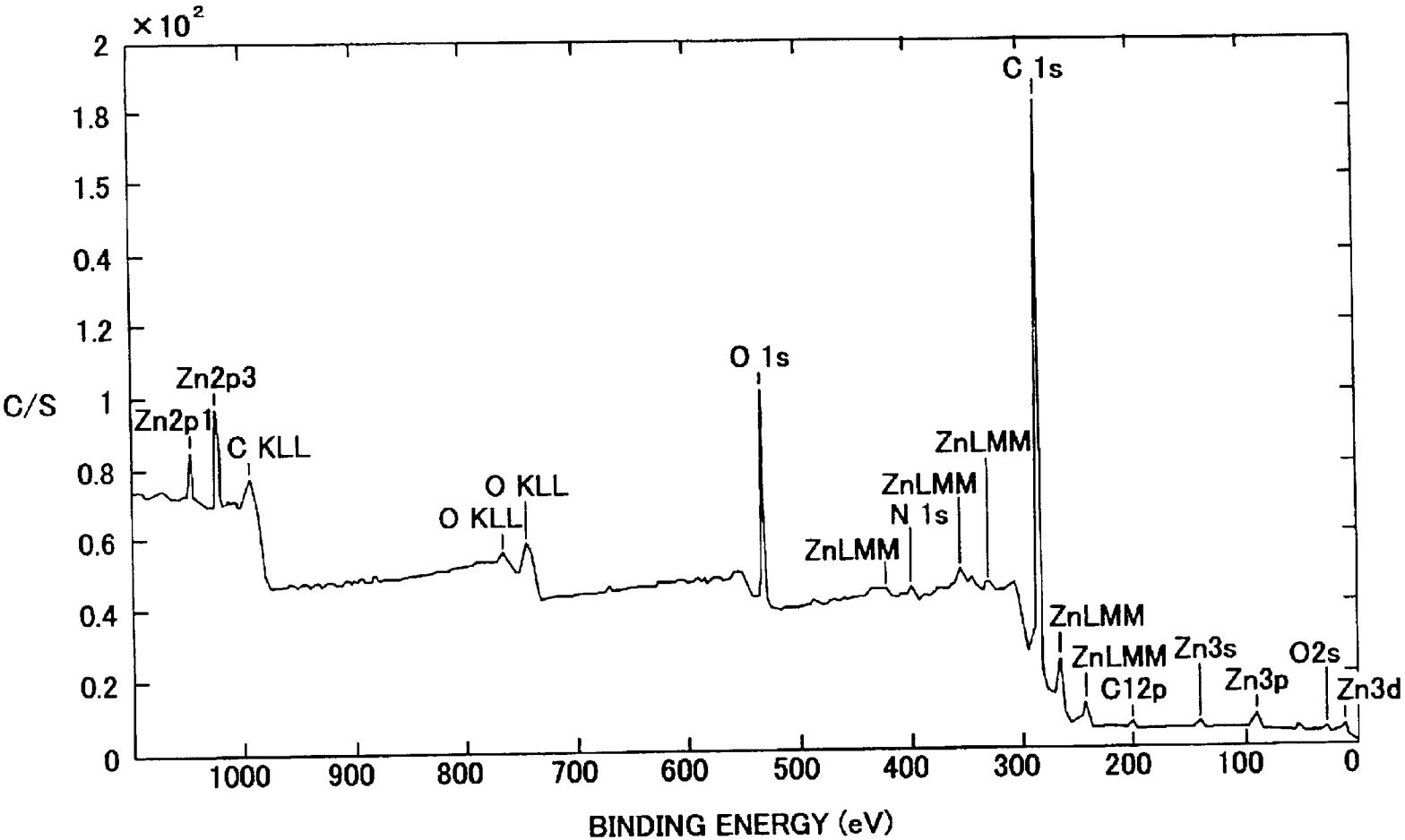
FIG. 1 is a graph illustrating an XPS spectrum of an embodiment of the charge controlling agent used in the toner of Example 1 of the present invention.
Figure 2A:
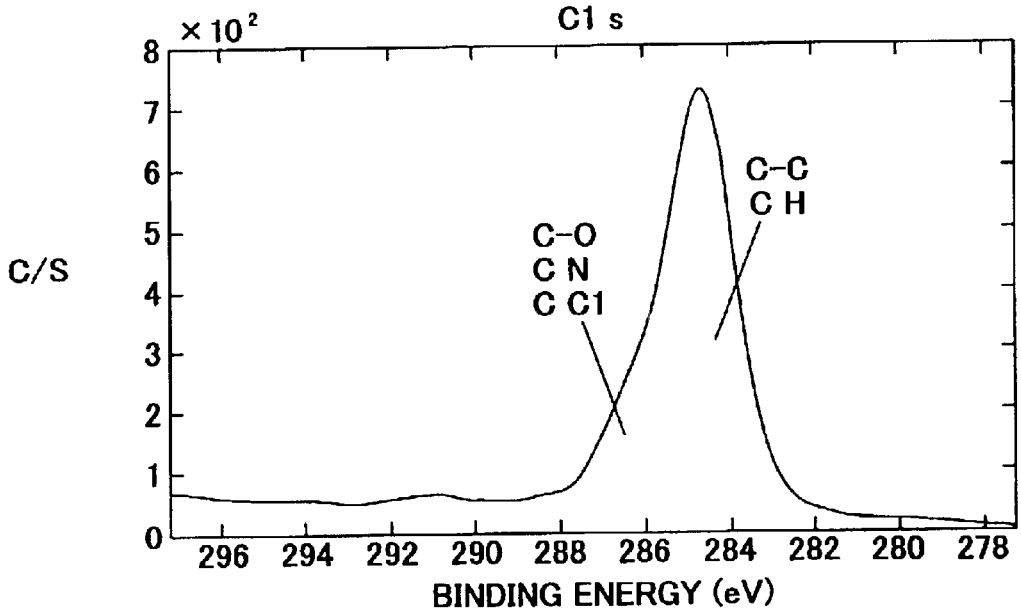
FIGS. 2A to 2E are enlarged views of the peaks of the XPS spectrum of FIG. 1.
Figure 2B:
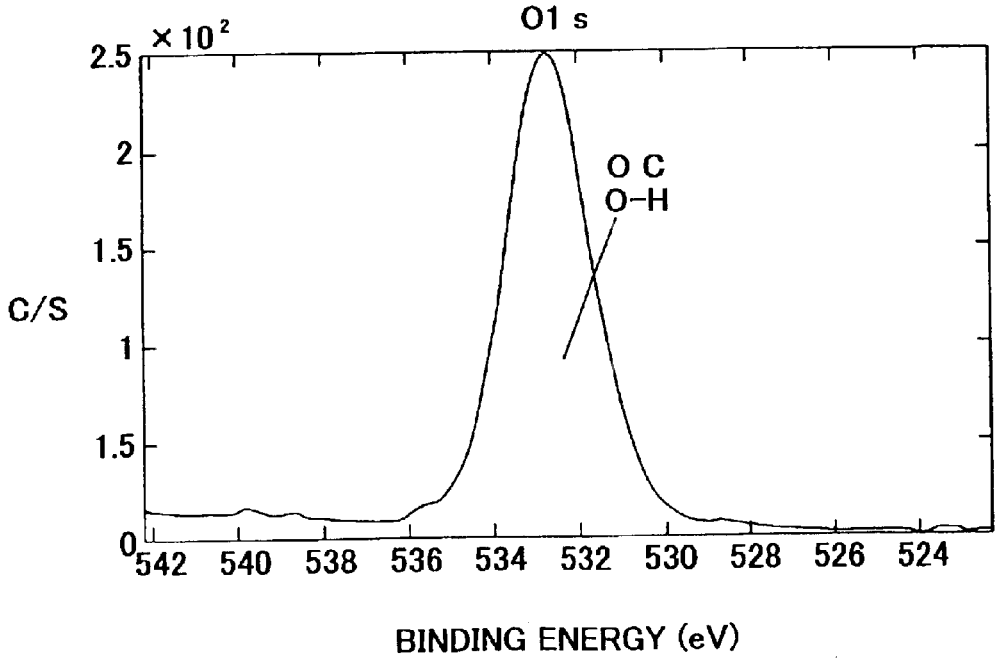
Figure 2C:
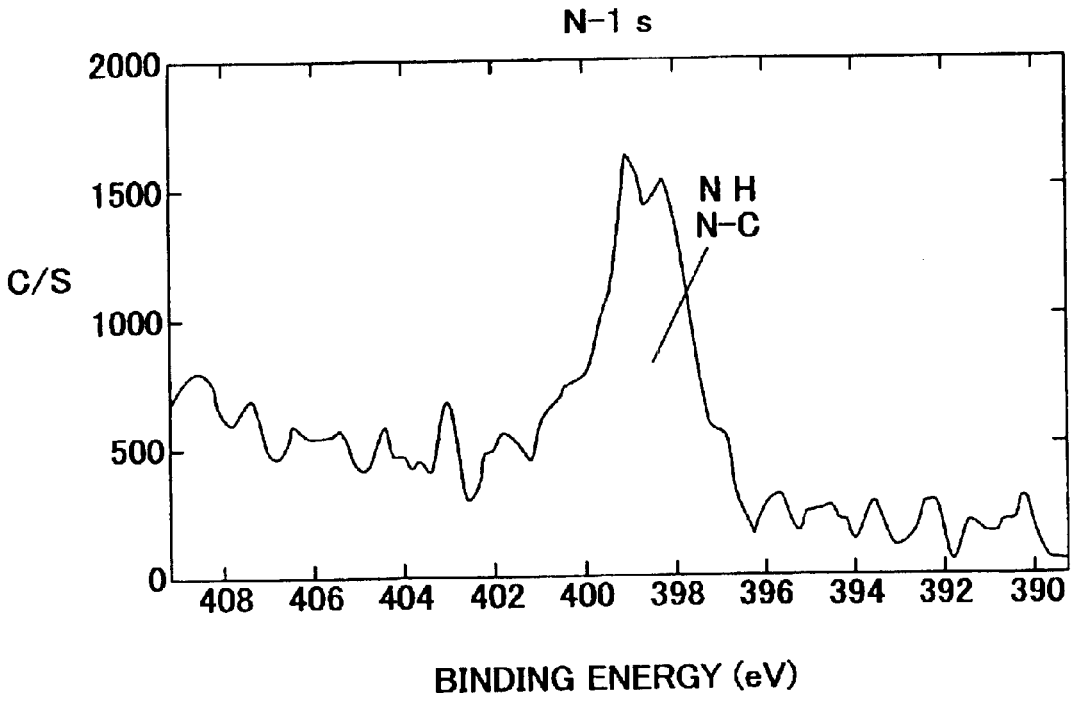
Figure 2D:
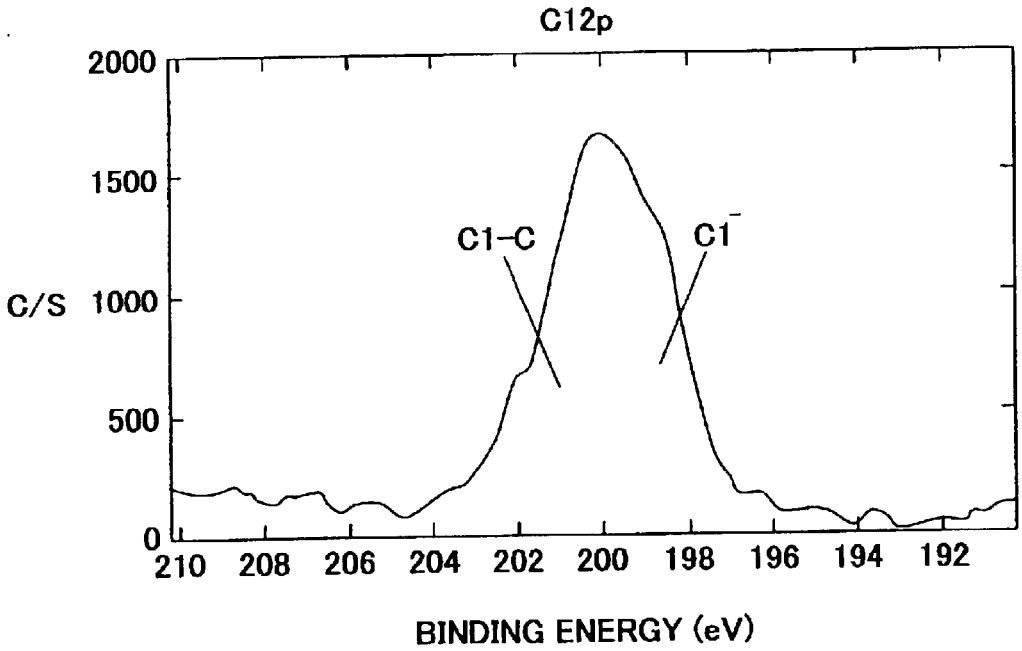
Figure 2E:
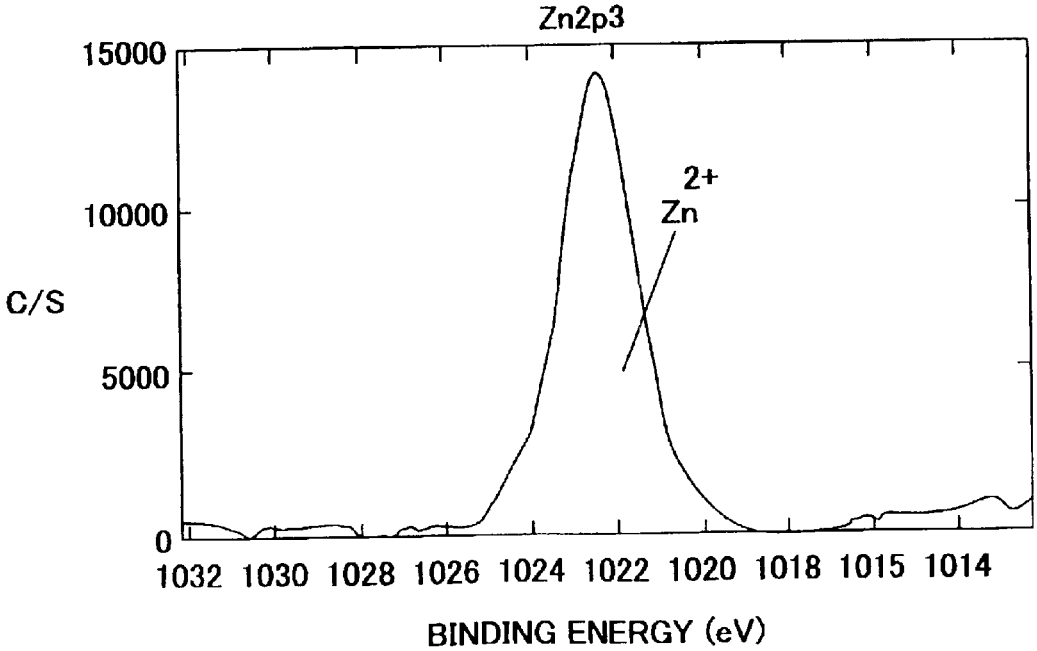

As mentioned above, the quantity of a charge controlling agent present on the surface of a toner having a relatively spherical form has to be carefully controlled. The present inventors have investigated the reason. As a result thereof, it is found that the following points are important.

(1) toners having a relatively spherical form have a surface area smaller than those of toners having an irregular form. Namely, the spherical toner particles have smaller surface areas which can be used for charging the toner than irregular toner particles. Therefore, the charge quantity and charging speed of the spherical toner particles are smaller than those of the irregular toner particles. Accordingly, a charge controlling agent has to be present on the surface of spherical particles in a certain amount or more. However, when the quantity of the charge controlling agent present on the surface of spherical particles is too large, the image forming members, such as photoreceptors, chargers and developing sleeves, contacting the toner tend to be contaminated with the charge controlling agent.

(2) When spherical toner particles contact such image forming members as mentioned above, the surface of the spherical toner particles tends to be locally melted and the charge controlling agent thereon tends to be embedded into the toner particles or deteriorate its properties. This is because the surface uniformly faces in all the directions. Accordingly, a charge controlling agent has to be present on the surface of spherical particles in a certain amount or more.

(3) When it is tried to include a charge controlling agent in a spherical toner prepared by a polymerization method using an aqueous liquid, almost all the charge controlling agent tends to be present in an aqueous phase because charge controlling agents have a high polarity and therefore have affinity for water. Namely, it is hard to include a charge controlling agent in a polymerization toner, and thereby good charging properties cannot be imparted to the polymerization toner.

Therefore, the present inventors have investigated the relationship between the shape of toner particles and charge properties thereof. As a result of the investigation, the toner of the present invention can be provided.

At first, methods for measuring several physical properties used in the present application will be explained.

Measurements of Spherical Degree

In the present invention, the spherical degree of particles is determined as follows:

(1) a suspension including particles to be measured is passed through a detection area formed on a plate in an measuring instrument; and (2) the particles are optically detected by a CCD camera and then the shapes thereof are analyzed.

The spherical degree of a particle is determined by the following equation:

$$\text{Spherical degree}=Cs/Cp$$

wherein Cp represents the circumference of the projected image of a particle and Cs represents the circumference of a circle whose area is the same as that of the projected image of the particle.

The spherical degree of toner particles can be determined as an average spherical degree by a flow-type particle image analyzer, FPIA-1000 manufactured by Toa Medical Electronics Co., Ltd.

Specifically, the method of determining the spherical degree of toner particles are as follows:

(1) 0.1 g to 0.5 g of a sample to be measured is mixed with 100 to 150 ml of water from which solid impurities have been removed and which includes 0.1 ml to 0.5 ml of a dispersant (i.e., a surfactant) such as an alkylbenzene sulfonic acid salt;

(2) the mixture is dispersed using an ultrasonic dispersing machine for about 1 to 3 minutes to prepare a suspension including particles of 3,000 to 10,000 per 1 micro-liter of the suspension; and (3) the average spherical degree of the sample in the suspension is determined by the measuring instrument mentioned above.

Measurements of Amount of Charge Controlling Agent on the Surface of Toner Particles In the toner of the present invention, it is very important that the charge controlling agent included in the toner is present on the surface and in the surface portion of the toner particles in an amount not less than the specified value mentioned above. It is especially important when the toner particles has a near spherical form. The quantity of a charge controlling agent present on the surface of toner particles can be determined by detecting the quantities of elements present on the surface and in the surface portion of the toner particles using ESCA (XPS). In this case, the element present on the surface and included in the surface portion having a thickness of about 5 nm is detected. Specifically, the quantities of elements can be determined by the following conditions:

(1) measuring instrument: X-ray Photoelectron Spectroscope Model 1600S manufactured by PHI;

(2) X-ray: Mg-Ka; and (3) Power of X-ray: 200W

The procedure for determining the quantities of elements on and in the surface portion is as follows:

(1) toner particles to be evaluated are dispersed in an analyzing area of 0.8 mm×2.0 mm;

(2) the quantities of the elements present on the surface or included in the surface portion of the toner particles are determined by the instrument mentioned above;

(3) among the detected elements, the quantity of an element which is included in the charge controlling agent but is not included in other toner constituents and which is one of the elements of from second to fifth periodical elements (i.e., the elements of from "Li" to "I") in the long form periodic table other than carbon, oxygen and rare gas elements is determined while considering the relative sensitivity factor of the elements which is provided by PHI.

The unit of the thus determined quantity of the elements is atomic percent (atomic %). The content (M) (% by weight) of the specific element present on the surface of the toner particles is determined as follows:

$$M=[(A\times W)/\{(A1\times W1)+(A2\times W2)+\ldots+(An\times Wn)\}]\times 100$$

wherein A represents the amount of the element (atomic %) and W represents the atomic weight of the element; and A1, A2 and An represent the amounts of elements detected when the surface portion is analyzed and W1, W2 and Wn represent the atomic weights thereof.

Measurements of Content (T) of Charge Controlling Agent in Toner Particles

The content of a specific element included in a charge controlling agent can be determined for example, by one of the following methods:

(1) a method in which the content of a specific element in the charge controlling agent is calculated from the formulation of the toner; and (2) a fluorescent X-ray analysis.

The latter method is preferably used. The procedure for the fluorescent X-ray analysis is as follows:

(1) three (3) grams of a toner is contained in a pellet forming machine and pressed upon application of 10 t/cm$^2$ to form a pellet of the toner having a diameter of 40 mm; and (2) the toner pellet is analyzed by a wavelength dispersive fluorescent X-ray analyzer RIX3000 manufactured by RIGAKU CORPORATION.

The content of a specific element in the toner is preferably determined as follows. At first, a working curve which shows the relationship between a content of the charge controlling agent in the toner and the strength of the fluorescent X-ray peak of an element included in only the charge controlling agent is previously prepared. Then the content (C) of the charge controlling agent in the toner is determined using the working curve. The unit of the thus obtained content (C) is % by weight. The value T (i.e., the content of the specific element in the toner) can be determined by the following equation:

$$T\ (\%\ \text{by weight})=C\times f$$

wherein C represents the content of the charge controlling agent in the toner; and f represents the content of the specific element in the charge controlling agent.

In the toner of the present invention, it is preferable that the charge controlling agent is hardly included inside of the toner particles. This is confirmed, for example, by the following method:

(1) toner particles are fully washed with a solvent which can dissolve the charge controlling agent included in the toner but cannot dissolve the binder resin and colorant in the toner;

(2) the washed toner particles is subjected to the analysis using a wavelength dispersive fluorescent X-ray analyzer.

Measurements of Charge Quantity of Toner Particles

In the present invention, the charge quantity of toner particles is determined as follows:

(1) 0.3 g of a toner and 6 g of a carrier which is prepared by coating a ferrite carrier having an average particle diameter of from 40 μm to 60 μm with a silicone resin in a thickness of from 0.2 μm to 0.3 μm are contained in a cylindrical stainless container having a diameter of 25 mm and a height of 35 mm;

(2) the container is set on a ball mill stand and rotated for a predetermined time (i.e., 15 sec or 600 sec) at a 280 rpm to mix the toner and the carrier (i.e., to charge the toner and carrier); and (3) the charge quantity (Q/M) of the toner in units of μC/g is determined by a blow-off method.

The charge rising property of the toner is defined by the following equation:

$$(Q/M1)/(Q/M2)$$

wherein Q/M1 represents the charge quantity of the toner when the mixture is mixed for 15 seconds and Q/M2 represents the charge quantity of the toner when the mixture is mixed for 600 seconds.

Measurements of diameter of wax dispersed in toner particles

In the present invention, the diameter of a wax dispersed in toner particles is defined as the diameter in the major axis direction of the wax.

Specifically, the measuring method is as follows:

(1) a toner particle is buried in an epoxy resin;

(2) an ultra-thin film of the toner particle having a thickness of about 100 μm is cut;

(3) the thin film is dyed with a ruthenium tetraoxide;

(4) the thin film is observed with a transmission electron microscope (TEM) of 10,000 power magnification and photographed;

(5) the photograph is analyzed with an image evaluation device such as RUZEX FT manufactured by Nireco to evaluate 50 pieces of toner particles; and (6) the absolute maximum length of each toner particle (i.e., a distance between the two farthest points on the outline of the cross section of each toner particle) is determined and the maximum lengths of the 50 toner particles are averaged.

Measurements of Particle Diameter Distribution of Toner Particles

The average particle diameter and particle diameter distribution of toner particles can be measured, for example, by an instrument such as COULTER COUNTER TA-II or a multicizer manufactured by Coulter Electronics, Inc. In the present invention, the COULTER COUNTER TA-II is used together with an interface which can output particle diameter distributions on number basis and volume basis and which is manufactured by Nikkaki Bios Co., Ltd. and a personal computer PC9801 manufactured by NEC Corp. The procedure is as follows:

(1) a surfactant serving as a dispersant, preferably 0.1 to 5 ml of a 1% aqueous solution of an alkylbenzenesulfonic acid salt, is added to an electrolyte such as 1% aqueous solution of first class NaCl or ISOTON-II manufactured by Coulter Scientific Japan;
(2) 2 to 20 mg of a sample to be measured is added into the mixture;
(3) the mixture is subjected to an ultrasonic dispersion treatment for about 1 to 3 minutes; and
(4) the volume average particle diameter (Dv) and number average particle diameter (Dn) of the sample are measured using the instrument and an aperture of 100 $\mu$m for toner particles having an average volume particle diameter of from 4.01 to 8.0 $\mu$m or an aperture of 50 $\mu$m for toner particles having an average volume particle diameter of from 2 to 4 $\mu$m.

In addition, the toner particles are evaluated with respect to a ratio (Dv/Dn).

Measurements of Molecular Weight Distribution of Binder Resin

In the present invention, the molecular weight of a binder resin included in a toner is measured by the following method:

(1) a toner of about 1 gram is precisely weighed;
(2) the toner is mixed with 10 to 20 g of tetrahydrofuran to prepare a tetrahydrofuran solution of the binder resin having a concentration of about 5 to 10%;
(3) tetrahydrofuran is flown through a column, which is heated in a heat chamber at 40° C., at a flow rate of 1 ml/min and 20 $\mu$l of the sample solution is injected thereto to determine the molecular weight distribution of the binder resin using a working curve concerning the relationship between a molecular weight and a retention time which is previously prepared using polystyrenes having a single molecular distribution of from $2.7\times10^2$ to $6.2\times10^6$.

As the detector, a RI (refractive index) detector is used. As the column, TSKgel, C1000H, G2000H, G2500H, G3000H, G4000H, G5000H, G6000H, G7000H and GMH, which are manufactured by TOSO CORPORATION, are used in combination.

The toner of the present invention includes a binder resin. Specific examples of the binder resin for use in the toner of the present invention include styrene polymers and substituted styrene polymers such as polystyrene, poly-p-chlorostyrene and polyvinyltoluene; styrene copolymers such as styrene-p-chlorostyrene copolymers, styrene-propylene copolymers, styrene-vinyltoluene copolymers, styrene-vinylnaphthalene copolymers, styrene-methyl acrylate copolymers, styrene-ethyl acrylate copolymers, styrene-butyl acrylate copolymers, styrene-octyl acrylate copolymers, styrene-methyl methacrylate copolymers, styrene-ethyl methacrylate copolymers, styrene-butyl methacrylate copolymers, styrene-methyl $\alpha$-chloromethacrylate copolymers, styrene-acrylonitrile copolymers, styrene-vinyl methyl ketone copolymers, styrene-butadiene copolymers, styrene-isoprene copolymers, styrene-acrylonitrile-indene copolymers, styrene-maleic acid copolymers and styrene-maleic acid ester copolymers; and other resins such as polymethyl methacrylate, polybutyl methacrylate, polyvinyl chloride, polyvinyl acetate, polyethylene, polypropylene, polyesters, epoxy resins, epoxy polyol resins, polyurethane resins, polyamide resins, polyvinyl butyral resins, acrylic resins, rosin, modified rosins, terpene resins, aliphatic or alicyclic hydrocarbon resins, aromatic petroleum resins, chlorinated paraffin, paraffin waxes, etc. These resins are used alone or in combination.

As the binder resin, urea-modified polyester resins (polyester resins having a urea bonding) can be used. Suitable urea-modified polyester resins include reaction products of a polyester prepolymer (A) with an amine (B). As the polyester prepolymer (A), for example, compounds prepared by reacting a polycondensation product of a polyol (1) and a polycarboxylic acid (2) which has a group having an active hydrogen with a polyisocyanate (3) are used. Suitable groups having an active hydrogen include a hydroxyl group (an alcoholic hydroxyl group and a phenolic hydroxyl group), an amino group, a carboxyl group, a mercapto group, etc. Among these groups, alcoholic hydroxyl groups are preferable.

Suitable polyols (1) include diols (1-1) and polyols (1-2) having three or more hydroxyl groups. Preferably diols (1-1) or mixtures in which a small amount of a polyol (1-2) is added to a diol (1-1) are used.

Specific examples of the diols (1-1) include alkylene glycol (e.g., ethylene glycol, 1,2-propylene glycol, 1,3-propylene glycol, 1,4-butanediol and 1,6-hexanediol); alkylene ether glycols (e.g., diethylene glycol, triethylene glycol, dipropylene glycol, polyethylene glycol, polypropylene glycol and polytetramethylene ether glycol); alicyclic diols (e.g., 1,4-cyclohexane dimethanol and hydrogenated bisphenol A); bisphenols (e.g., bisphenol A, bisphenol F and bisphenol S); adducts of the alicyclic diols mentioned above with an alkylene oxide (e.g., ethylene oxide, propylene oxide and butylene oxide); adducts of the bisphenols mentioned above with an alkylene oxide (e.g., ethylene oxide, propylene oxide and butylene oxide); etc.

Among these compounds, alkylene glycols having from 2 to 12 carbon atoms and adducts of bisphenols with an alkylene oxide are preferable. More preferably, adducts of bisphenols with an alkylene oxide, or mixtures of an adduct of bisphenols with an alkylene oxide and an alkylene glycol having from 2 to 12 carbon atoms are used.

Specific examples of the polyols (1-2) include aliphatic alcohols having three or more hydroxyl groups (e.g., glycerin, trimethylol ethane, trimethylol propane, pentaerythritol and sorbitol); polyphenols having three or more hydroxyl groups (trisphenol PA, phenol novolak and cresol novolak); adducts of the polyphenols mentioned above with an alkylene oxide; etc.

Suitable polycarboxylic acids include dicarboxylic acids (2-1) and polycarboxylic acids (2-2) having three or more carboxyl groups. Preferably dicarboxylic acids (2-1) or mixtures in which a small amount of a polycarboxylic acid (2-2) is added to a dicarboxylic acid (2-1) are used.

Specific examples of the dicarboxylic acids (2-1) include alkylene dicarboxylic acids (e.g., succinic acid, adipic acid and sebacic acid); alkenylene dicarboxylic acids (e.g., maleic acid and fumaric acid); aromatic dicarboxylic acids (e.g., phthalic acid, isophthalic acid, terephthalic acid and naphthalene dicarboxylic acids; etc. Among these compounds, alkenylene dicarboxylic acids having from 4 to 20 carbon atoms and aromatic dicarboxylic acids having from 8 to 20 carbon atoms are preferably used.

Specific examples of the polycarboxylic acids (2-2) having three or more hydroxyl groups include aromatic polycarboxylic acids having from 9 to 20 carbon atoms (e.g., trimellitic acid and pyromellitic acid).

As the polycarboxylic acid (2), anhydrides or lower alkyl esters (e.g., methyl esters, ethyl esters or isopropyl esters) of the polycarboxylic acids mentioned above can be used for the reaction with a polyol (1).

Suitable mixing ratio (i.e., an equivalence ratio [OH]/[COOH]) of a polyol (1) to a polycarboxylic acid (2) is from 2/1 to 1/1, preferably from 1.5/1 to 1/1 and more preferably from 1.3/1 to 1.02/1.

Specific examples of the polyisocyanates (3) include aliphatic polyisocyanates (e.g., tetramethylene diisocyanate, hexamethylene diisocyanate and 2,6-diisocyanate methylcaproate); alicyclic polyisocyanates (e.g., isophorone diisocyanate and cyclohexylmethane diisocyanate); aromatic didicosycantes (e.g., tolylene diisocyanate and diphenylmethane diisocyanate); aromatic aliphatic diisocyanates (e.g., α, α, α', α'-tetramethyl xylylene diisocyanate); isocyanurates; blocked polyisocyanates in which the polyisocyanates mentioned above are blocked with phenol derivatives, oximes or caprolactams; etc. These compounds can be used alone or in combination.

Suitable mixing ratio (i.e., [NCO]/[OH]) of a polyisocyanate (3) a polyester is from 5/1 to 1/1, preferably from 4/1 to 1.2/1 and more preferably from 2.5/1 to 1.5/1. When the [NCO]/[OH] ratio is too large, the low temperature fixability of the toner deteriorates. In contrast, when the ratio is too small, the content of the urea group in the modified polyesters decreases and thereby the hot-offset resistance of the toner deteriorates. The content of the constitutional component of a polyisocyanate (3) in the polyester prepolymer (A) having a polyisocyanate group at its end portion is from 0.5 to 40% by weight, preferably from 1 to 30% by weight and more preferably from 2 to 20% by weight. When the content is too low, the hot offset resistance of the toner deteriorates and in addition the heat resistance and low temperature fixability of the toner also deteriorate. In contrast, when the content is too high, the low temperature fixability of the toner deteriorates.

The number of the isocyanate group included in a molecule of the polyester prepolymer (A) is not less than 1, preferably from 1.5 to 3, and more preferably from 1.8 to 2.5. When the number of the isocyanate group is too small, the molecular weight of the resultant urea-modified polyester decreases and thereby the hot offset resistance deteriorate.

Specific examples of the amines (B) include diamines (B1), polyamines (B2) having three or more amino groups, amino alcohols (B3), amino mercaptans (B4), amino acids (B5) and blocked amines (B6) in which the amines (B1–B5) mentioned above are blocked.

Specific examples of the amines (1) include aromatic diamines (e.g., phenylene diamine, diethyltoluene diamine and 4,4'-diaminodiphenyl methane); alicyclic diamines (e.g., 4,4'-diamino-3,3'-dimethyldicyclohexyl methane, diaminocyclohexane and isophoron diamine); aliphatic diamines (e.g., ethylene diamine, tetramethylene diamine and hexamethylene diamine); etc.

Specific examples of the polyamines (B2) having three or more amino groups include diethylene triamine, triethylene tetramine. Specific examples of the amino alcohols (B3) include ethanol amine and hydroxyethyl aniline. Specific examples of the amino mercaptan (B4) include aminoethyl mercaptan and aminopropyl mercaptan. Specific examples of the amino acids include amino propionic acid and amino caproic acid. Specific examples of the blocked amines (B6) include ketimine compounds which are prepared by reacting one of the amines B1–B5 mentioned above with a ketone such as acetone, methyl ethyl ketone and methyl isobutyl ketone; oxazoline compounds, etc. Among these compounds, diamines (B1) and mixtures in which a diamine is mixed with a small amount of a polyamine (B2).

The molecular weight of the urea-modified polyesters can be controlled using an elongation anticatalyst, if desired. Specific examples of the elongation anticatalyst include monoamines (e.g., diethyle amine, dibutyl amine, butyl amine and lauryl amine), and blocked amines (i.e., ketimine compounds) prepared by blocking the monoamines mentioned above.

The mixing ratio (i.e., a ratio [NCO]/[NHx]) of the content of the prepolymer (A) having an isocyanate group to the amine (B) is from 1/2 to 2/1, preferably from 1.5/1 to 1/1.5 and more preferably from 1.2/1 to 1/1.2. When the mixing ratio is too low or too high, the molecular weight of the resultant urea-modified polyester decreases, resulting in deterioration of the hot offset resistance of the resultant toner.

The urea-modified polyesters may include an urethane bonding as well as a urea bonding. The molar ratio (urea/urethane) of the urea bonding to the urethane bonding is from 100/0 to 10/90, preferably from 80/20 to 20/80 and more preferably from 60/40 to 30/70. When the content of the urea bonding is too low, the hot offset resistance of the resultant toner deteriorates.

The urea-modified polyesters can be prepared, for example, by a method such as one-shot methods or prepolymer methods. The weight average molecular weight of the urea-modified polyesters is not less than 10,000, preferably from 20,000 to 10,000,000 and more preferably from 30,000 to 1,000,000. When the weight average molecular weight is too low, the hot offset resistance of the resultant toner deteriorates. The number average molecular weight of the urea-modified polyesters is not particularly limited (i.e., the weight average molecular weight should be primarily controlled so as to be in the range mentioned above). However, when a urea-modified polyester is used alone, the number average molecular weight is not greater than 20,000, preferably from 1,000 to 10,000 and more preferably from 2,000 to 8,000. When the number average molecular weight is too high, the low-temperature fixability of the resultant toner deteriorates, and in addition the gloss of full color images decreases.

Colorant

Suitable colorants for use in the toner of the present invention include known dyes and pigments. Specific examples of the colorants include carbon black, Nigrosine dyes, black iron oxide, Naphthol Yellow S, HANSA Yellow (10G, 5G and G), Cadmium Yellow, yellow iron oxide, bess, chrome yellow, Titan Yellow, polyazo yellow, Oil Yellow, HANSA Yellow (GR, A, RN and R), Pigment Yellow L, Benzidine Yellow (G and GR), Permanent Yellow (NCG), Vulcan Fast Yellow (5G and R), Tartrazine Lake, Quinoline Yellow Lake, Anthrazane Yellow BGL, isoindolinone yellow, red iron oxide, red lead, orange lead, cadmium red, cadmium mercury red, antimony orange, Permanent Red 4R, Para Red, Fire Red, p-chloro-o-nitroaniline red, LITHOL Fast Scarlet G, Brilliant Fast Scarlet, Brilliant Carmine BS, Permanent Red (F2R, F4R, FRL, FRLL and F4RH), Fast Scarlet VD, Vulcan Fast Rubine B, Brilliant Scarlet G, LITHOL Rubine GX, Permanent Red F5R, Brilliant Carmine 6B, Pigment Scarlet 3B, Bordeaux 5B, Toluidine Maroon, Permanent Bordeaux F2K, Helio Bordeaux BL, Bordeaux 10B, BON Maroon Light, BON Maroon Medium, Eosin Lake, Rhodamine Lake B, Rhodamine Lake Y, Alizarine Lake, Thioindigo Red B, Thioindigo Maroon, Oil Red, Quinacridone Red, Pyrazobone Red, polyazo red, Chrome Vermilion, Benzidine Orange, perynone orange, Oil Orange, cobalt blue, cerulean blue, Alkali Blue Lake, Peacock Blue Lake, Victoria Blue Lake, metal-free Phthabocyanine Blue, Phthabocyanine Blue, Fast Sky Blue, Indanthrene Blue (RS and BC), Indigo, ultramarine, Prussian blue, Anthraquinone Blue, Fast Violet B, Methyl Violet Lake, cobalt violet, manganese violet, dioxane violet, Anthraquinone Violet, Chrome Green, zinc green, chromium oxide, viridian, emerald green, Pigment Green B, Naplithol Green B, Green Gold, Acid Green Lake, Malachite Green Lake, Phthalocyanine Green, Anthraquinone Green, titanium oxide, zinc oxide, lithopone and the like. These materials are used alone or in combination.

The content of the colorant in the toner is preferably from 0.1 to 50 parts by weight per 100 parts by weight of the binder resin included in the toner.

Wax

The toner preferably includes a wax to improve the releasability thereof. Suitable waxes for use in the toner include waxes having a melting point of from 40 to 120° C. and preferably from 50 to 110° C. When the melting point of the wax included in the toner is too high, the low temperature fixability of the resultant toner deteriorates. To the contrary, when the melting point is too low, the offset resistance and durability of the resultant toner deteriorate.

The melting point of waxes can be determined by a method using a differential scanning calorimeter (i.e., DSC). Namely, a few milligrams of a sample is heated at a constant heating speed (for example, 10° C./min) to determine the temperature at which the sample melts (i.e., the temperature at which a peak due to melting of the sample is observed).

Specific examples of the waxes include solid paraffin waxes, microcrystalline waxes, rice waxes, fatty acid amide waxes, fatty acid waxes, aliphatic monoketones, fatty acid metal salt waxes, fatty acid ester waxes, partially-saponified fatty acid ester waxes, silicone varnishes, higher alcohols, carnauba waxes, polyolefins such as low molecular weight polyethylene and polypropylene, and the like waxes. In particular, polyolefins having a softening point of from 70° C. to 150° C., and preferably from 120° C. to 150° C., which is determined by a ring and ball method, are preferable.

Method for Manufacturing Toner Particles

Then the method of preparing the toner of the present invention will be explained.

The toner of the present invention can be typically prepared by preparing mother toner particles including at least a colorant and a binder resin and then adhering a charge controlling agent to the surface of the mother toner particles. The mother toner particles including at least a colorant and a binder resin can be prepared, for example, by the following method:

(1) toner constituents including at least a colorant and a binder resin are mechanically mixed (mixing process);
(2) the toner constituents are kneaded while heated (kneading process);
(3) the kneaded mixture is cooled and then pulverized to form a color powder (pulverizing process); and
(4) the color powder is classified to prepare mother toner particles (classifying process).

The color powder having an undesired particle diameter (hereinafter referred to as a by-product) may be reused for the next mixing and kneading processes. When the by-product is re-used, the mixing ratio of the by-product to the new raw materials is preferably 1/99 to 50/50 by weight.

The procedure for the mixing process is not particularly limited, and the toner constituents are merely mixed mechanically using a known mixer having a rotating blade.

In the kneading process following the mixing process, the mixture is contained in a kneader and then kneaded upon application of heat. Suitable kneaders include the kneaders include single-axis or double-axis continuous kneaders and batch kneaders such as roll mills. Specific examples of the kneaders include KTK double-axis extruders manufactured by Kobe Steel, Ltd., TEM extruders manufactured by Toshiba Machine Co., Ltd., double-axis extruders manufactured by KCK Co., Ltd., PCM double-axis extruders manufactured by Ikegai Corp., and KO-KNEADER manufactured by Buss AG.

In the kneading process, it is important to control the kneading conditions so as not to cut the molecular chains of the binder resin used in the toner. Specifically, when the mixture is kneaded at a temperature much lower than the softening point of the binder resin used, the molecular chains of the binder resin tend to be cut. When the kneading temperature is much higher than the softening point, the pigment in the mixture cannot be fully dispersed.

In the pulverizing process, it is preferable that the kneaded mixture is at first crushed to prepare coarse particles (hereinafter referred to as a crushing step) and then the coarse particles are pulverized to prepare fine particles (hereinafter referred to as a pulverizing step). In the pulverizing step, a pulverizing method in which coarse particles are pulverized by being collided against a collision plate by jet air or a pulverizing method in which coarse particles are pulverized at a narrow gap between a mechanically-rotating rotor and a stator is preferably used.

In the classifying process, the color powder is air-classified using centrifugal force to obtain toner particles (i.e., a mother toner) having a predetermined average particle diameter (for example, from 3 $\mu$m to 20 $\mu$m). Then the toner particles are subjected to a shape controlling treatment using a SURFUSION SYSTEM manufactured by HOSOKAWA MICRON CORPORATION, HYBRIDIZER manufactured by Nara Machine Industry Co., Ltd. or the like machine so as to have a spherical degree of from 0.95 to 0.99.

Method for Manufacturing Toner in Aqueous Medium

The toner of the present invention can be prepared by preparing particles mainly including a binder resin and a colorant by the method mentioned below, and adhering a charge controlling agent to the surface of the particles.

The particles can be prepared, for example, by the following methods:

(1) a colorant dispersed in a resin, which is melted or dissolved in a solvent, is sprayed in the air or added into an aqueous medium to prepare particles having a particle diameter suitable for toners (resin dispersion methods);
(2) a colorant dispersed in a polymerizable monomer is dispersed in an aqueous medium and then polymerized to prepare particles having a particle diameter suitable for toners (suspension polymerization methods);
(3) a polymer emulsion is mixed with a colorant and then the mixture is aggregated or coagulated to prepare particles having a particle diameter suitable for toners (polymer emulsion coagulation methods);
(4) a monomer solution is polymerized to precipitate polymer particles having a particle diameter suitable for toners (dispersion polymerization methods); etc.

Among these methods, the suspension polymerization methods and resin dispersion methods are preferable because spherical particles can be easily prepared.

Suitable aqueous medium for use in the toner manufacturing method mentioned above include water and mixture of water with a solvent which can be mixed with water. Specific examples of such a solvent include alcohols (e.g., methanol, isopropanol and ethylene glycol), dimethylformamide, tetrahydrofuran, cellosolves (e.g., methyl cellosolve), lower ketones (e.g., acetone and methyl ethyl ketone), etc.

When the resin dispersion methods are used, the way to incorporate a polymer having a urea bonding in toner particles is as follows. A dispersion of a prepolymer (A) having an isocyanate group in an aqueous medium is reacted with an amine (B). Alternatively, a urea-modified polyester resin which is previously prepared may be used.

In order to prepare a dispersion in which a urea-modified polyester resin or a prepolymer (A) is stably dispersion in an aqueous medium, a method in which toner constituents including a urea-modified polyester or a prepolymer (A) are added into an aqueous medium and then dispersed upon application of shear stress is preferably used. A prepolymer (A) and other toner constituents such as colorants, colorant master batches, release agents, charge controlling agents, unmodified polyester resins, etc. may be added into an aqueous medium at the same time when a dispersion is prepared. However, it is preferable to add a mixture of the toner constituents, which is previously prepared, in an aqueous medium. In addition, colorants, release agents, charge controlling agents, etc., are not necessarily added to the aqueous dispersion before particles are formed, and may be added thereto after particles are prepared in the aqueous medium. A method in which particles, which are previously formed without a colorant, are dyed by a known dying method can also be used.

The dispersion method is not particularly limited, and low-speed shearing methods, high speed shearing methods, friction methods, high pressure jet methods, ultrasonic methods, etc. can be used. Among these methods, high speed shearing methods are preferable because particles having a particle diameter of from 2 $\mu$m to 8 $\mu$m can be easily prepared.

When a high speed shearing type dispersion machine is used, the rotation speed is not particularly limited, but the rotation speed is typically from 1,000 to 30,000 rpm, and preferably from 5,000 to 20,000 rpm. The dispersion time is not also particularly limited, but is typically from 0.1 to 5 minutes. The temperature in the dispersion process is typically from 0 to 150° C. (under pressure), and preferably from 40 to 98° C. When the temperature is relatively high, a urea-modified polyester or a prepolymer (A) can be easily dispersed because the dispersion has a low viscosity.

The weight ratio (T/M) of the toner constituents (T) to aqueous medium (M) is typically from 100/50 to 100/2,000, and preferably from 100/100 to 100/1,000. When the ratio is too large (i.e., the quantity of the aqueous medium is small), the dispersion of the toner constituents in the aqueous medium is not satisfactory. In contrast, when the ratio is too small, the manufacturing costs increase.

A dispersant can be preferably used when a dispersion is prepared, to prepare a dispersion including particles having a sharp particle diameter distribution and to prepare a stable dispersion.

Specific examples of the dispersants, which can disperse or emulsify an oil phase in which toner constituents are dispersed in an aqueous liquid, include anionic surfactants such as alkylbenzene sulfonic acid salts, α-olefin sulfonic acid salts, and phosphoric acid salts; cationic surfactants such as amine salts (e.g., alkyl amine salts, aminoalcohol fatty acid derivatives, polyamine fatty acid derivatives and imidazoline), and quaternary ammonium salts (e.g., alkyltrimethyl ammonium salts, dialkyldimethyl ammonium salts, alkyldimethyl benzyl ammonium salts, pyridinium salts, alkyl isoquinolinium salts and benzethonium chloride); nonionic surfactants such as fatty acid amide derivatives, polyhydric alcohol derivatives; and ampholytic surfactants such as alanine, dodecyldi (aminoethyl) glycin, di) octylaminoethyle) glycin, and N-alkyl-N,N-dimethylammonium betaine.

By using a surfactant having a fluoroalkyl group, a dispersion having good dispersibility can be prepared even when a small amount of the surfactant is used. Specific examples of anionic surfactants having a fluoroalkyl group include fluoroalkyl carboxylic acids having from 2 to 10 carbon atoms and their metal salts, disodium perfluorooctanesulfonylglutamate, sodium 3-{omega-fluoroalkyl(C6–C11)oxy}-1-alkyl(C3–C4) sulfonate, sodium 3-{omega-fluoroalkanoyl(C6–C8)-N-ethylamino}-1-propanesulfonate, fluoroalkyl(C11–C20) carboxylic acids and their metal salts, perfluoroalkylcarboxylic acids and their metal salts, perfluoroalkyl(C4–C12)sulfonate and their metal salts, perfluorooctanesulfonic acid diethanol amides, N-propyl-N-(2-hydroxyethyl)perfluorooctanesulfone amide, perfluoroalkyl(C6–C10) sulfoneamidepropyltrimethylammonium salts, salts of perfluoroalkyl (C6–C10)-N-ethylsulfonyl glycin, monoperfluoroalkyl(C6–C16)ethylphosphates, etc.

Specific examples of the marketed products of such surfactants include SURFLON S-111, S-112 and S-113, which are manufactured by Asahi Glass Co., Ltd.; FRORARD FC-93, FC-95, FC-98 and FC-129, which are manufactured by Sumitomo 3M Ltd.; UNIDYNE DS-101 and DS-102, which are manufactured by Daikin Industries, Ltd.; MEGAFACE F-110, F-120, F-113, F-191, F-812 and F-833 which are manufactured by Dainippon Ink and Chemicals, Inc.; ECTOP EF-102, 103, 104, 105, 112, 123A, 306A, 501, 201 and 204, which are manufactured by Tohchem Products Co., Ltd.; FUTARGENT F-100 and F150 manufactured by Neos; etc.

Specific examples of the cationic surfactants, which can disperse an oil phase including toner constituents in water, include primary, secondary and tertiary aliphatic amines having a fluoroalkyl group, aliphatic quaternary ammonium salts such as perfluoroalkyl(C6–C10) sulfoneamidepropyltrimethylammonium salts, benzalkonium salts, benzetonium chloride, pyridinium salts, imidazolinium salts, etc. Specific examples of the marketed products thereof include SURFLON S-121 (from Asahi Glass Co., Ltd.); FRORARD FC-135 (from Sumitomo 3M Ltd.); UNIDYNE DS-202 (from Daikin Industries, Ltd.); MEGAFACE F-150 and F-824 (from Dainippon Ink and Chemicals, Inc.); ECTOP EF-132 (from Tohchem Products Co., Ltd.); FUTARGENT F-300 (from Neos); etc.

In addition, inorganic dispersants, which are hardly soluble in water, such as tricalcium phosphate, calcium carbonate, titanium oxide, colloidal silica, and hydroxyapatite can also be used.

Further, it is possible to stably disperse toner constituents in water using a polymeric protection colloid. Specific examples of such protection colloids include polymers and copolymers prepared using monomers such as acids (e.g., acrylic acid, methacrylic acid, α-cyanoacrylic acid, α-cyanomethacrylic acid, itaconic acid, crotonic acid, fumaric acid, maleic acid and maleic anhydride), acrylic monomers having a hydroxyl group (e.g., β-hydroxyethyl acrylate, β-hydroxyethyl methacrylate, β-hydroxypropyl acrylate, β-hydroxypropyl methacrylate, γ-hydroxypropyl acrylate, γ-hydroxypropyl methacrylate, 3-chloro-2-hydroxypropyl acrylate, 3-chloro-2-hydroxypropyl methacrylate, diethyleneglycolmonoacrylic acid esters, diethyleneglycolmonomethacrylic acid esters, glycerinmonoacrylic acid esters, N-methylolacrylamide and N-methylolmethacrylamide), vinyl alcohol and its ethers (e.g., vinyl methyl ether, vinyl ethyl ether and vinyl propyl ether), esters of vinyl alcohol with a compound having a carboxyl group (i.e., vinyl acetate, vinyl propionate and vinyl butyrate); acrylic amides (e.g, acrylamide, methacrylamide and diacetoneacrylamide) and their methylol compounds, acid chlorides (e.g., acrylic acid chloride and methacrylic acid chloride), and monomers having a nitrogen atom or an alicyclic ring having a nitrogen atom (e.g., vinyl pyridine, vinyl pyrrolidone, vinyl imidazole and ethylene imine).

In addition, polymers such as polyoxyethylene compounds (e.g., polyoxyethylene, polyoxypropylene, polyoxyethylenealkyl amines, polyoxypropylenealkyl amines, polyoxyethylenealkyl amides, polyoxypropylenealkyl amides, polyoxyethylene nonylphenyl ethers, polyoxyethylene laurylphenyl ethers, polyoxyethylene stearylphenyl esters, and polyoxyethylene nonylphenyl esters); and cellulose compounds such as methyl cellulose, hydroxyethyl cellulose and hydroxypropyl cellulose, can also be used as the polymeric protective colloid.

When compounds such as calcium phosphate which are soluble in an acid or alkali are used as a dispersion stabilizer, the resultant particles are preferably added into an acid such as hydrochloric acid and then washed with water to remove calcium phosphate from the particles. In addition, calcium phosphate can be removed using a zymolytic method.

When a dispersant is used, the resultant particles are preferably washed after the particles are subjected to an elongation and/or a crosslinking reaction to impart good charge ability to the particles.

When an aqueous dispersion or emulsion is prepared, a solvent which can dissolve the urea-modified polyester or prepolymer (A) used is preferably used because the resultant particles have a sharp particle diameter distribution. The solvent is preferably volatile and has a boiling point lower than 100° C. because of easily removed from the dispersion after the particles are formed.

Specific examples of such a solvent include toluene, xylene, benzene, carbon tetrachloride, methylene chloride, 1,2-dichloroethane, 1,1,2-trichloroethane, trichloroethylene, chloroform, monochlorobenzene, dichloroethylidene, methyl acetate, ethyl acetate, methyl ethyl ketone, methyl isobutyl ketone, etc. These solvents can be used alone or in combination. Among these solvents, aromatic solvents such as toluene and xylene; and halogenated hydrocarbons such as methylene chloride, 1,2-dichloroethane, chloroform, and carbon tetrachloride are preferably used.

The addition quantity of such a solvent is from 0 to 300 parts by weight, preferably from 0 to 100 and more preferably from 25 to 70 parts by weight, per 100 parts by weight of the prepolymer (A) used. When such a solvent is used to prepare a particle dispersion, the solvent is removed upon application of heat thereto under a normal or reduced pressure after the particles are subjected to an elongation treatment and/or a crosslinking treatment.

The elongation time and/or crosslinking time of the particles are determined depending on the reactivity of the isocyanate of the prepolymer (A) used with the amine used. However, the elongation time and/or crosslinking time are typically from 10 minutes to 40 hours, and preferably from 2 to 20 hours. The reaction temperature is typically from 0 to 150° C. and preferably from 40° C. to 98° C. In addition, known catalysts such as dibutyl tin laurate and dioctyl tin laurate can be added, if desired, when the reaction is performed.

In order to remove an organic solvent from the thus prepared emulsion or dispersion, a method in which the emulsion or dispersion is gradually heated to perfectly evaporate the organic solvent in the drops of the oil phase can be used. Alternatively, a method in which the emulsion or dispersion is sprayed in a dry environment to dry the organic solvent in the drops of the oil phase and water in the dispersion, resulting in formation of toner particles, can be used. Specific examples of the dry environment include gases of air, nitrogen, carbon dioxide, combustion gas, etc., which are preferably heated to a temperature not lower than the boiling point of the solvent having the highest boiling point among the solvents used in the emulsion or dispersion. Toner particles having desired properties can be rapidly prepared by performing this treatment using a spray dryer, a belt dryer, a rotary kiln, etc.

When the thus prepared toner particles have a wide particle diameter distribution even after the particles are subjected to a washing treatment and a drying treatment, the toner particles are preferably subjected to a classification treatment using a cyclone, a decanter or a method utilizing centrifuge to remove fine particles therefrom. However, it is preferable to perform the classification operation in the liquid having the particles in view of efficiency. The toner particles having an undesired particle diameter can be reused as the raw materials for the kneading process. Such toner particles for reuse may be in a dry condition or a wet condition.

The dispersant used is preferably removed from the particle dispersion. The dispersant is preferably removed from the dispersion when the classification treatment is performed.

The thus prepared toner particles are then mixed with one or more other particulate materials such as release agents, charge controlling agents, fluidizers and colorants optionally upon application of mechanical impact thereto to fix the particulate materials on the toner particles.

Specific examples of such mechanical impact application methods include methods in which a mixture is mixed with a highly rotated blade and methods in which a mixture is put into a jet air to collide the particles against each other or a collision plate.

Specific examples of such mechanical impact applicators include ONG MILL (manufactured by Hosokawa Micron Co., Ltd.), modified I TYPE MILL in which the pressure of air used for pulverizing is reduced (manufactured by Nippon Pneumatic Mfg. Co., Ltd.), HYBRIDIZATION SYSTEM (manufactured by Nara Machine Co., Ltd.), KRYPTRON SYSTEM (manufactured by Kawasaki Heavy Industries, Ltd.), automatic mortars, etc.

The toner of the present invention includes a charge controlling agent. Specific examples of the charge controlling agent include known charge controlling agents such as Nigrosine dyes, triphenylmethane dyes, metal complex dyes including chromium, chelate compounds of molybdic acid, Rhodamine dyes, alkoxyamines, quaternary ammonium salts (including fluorine-modified quaternary ammonium salts), alkylamides, phosphor and compounds including phosphor, tungsten and compounds including tungsten, fluorine-containing activators, metal salts of salicylic acid, salicylic acid derivatives, etc.

Specific examples of the marketed products of the charge controlling agents include BONTRON 03 (Nigrosine dyes), BONTRON P-51 (quaternary ammonium salt), BONTRON S-34 (metal-containing azo dye), E-82 (metal complex of oxynaphthoic acid), E-84 (metal complex of salicylic acid), and E-89 (phenolic condensation product), which are manufactured by Orient Chemical Industries Co., Ltd.; TP-302 and TP-415 (molybdenum complex of quaternary ammonium salt), which are manufactured by Hodogaya Chemical Co., Ltd.; COPY CHARGE PSY VP2038 (quaternary ammonium salt), COPY BLUE (triphenyl methane derivative), COPY CHARGE NEG VP2036 and NX VP434 (quaternary ammonium salt), which are manufactured by Hoechst AG; LRA-901, and LR-147 (boron complex), which are manufactured by Japan Carlit Co., Ltd.; copper phthalocyanine, perylene, quinacridone, azo pigments and polymers having a functional group such as a sulfonate group, a carboxyl group, a quaternary ammonium group, etc.

Among these compounds, metal complexes and metal salts of salicylic acid and its derivatives are preferable.

Suitable charge controlling agents for use in the toner of the present invention include crystalline compounds which can be easily pulverized upon application of stress so as to be fine particles having a particle diameter of about 1 $\mu$m. The charge controlling agent may be included in toner particles. The content of the charge controlling agent in the toner composition is preferably from 0.01 to 2 parts by weight, preferably from 0.05 to 1 part and more preferably from 0.1 to 0.5 parts by weight, per 100 parts by weight of a particulate resin including a coloring agent.

Among the charge controlling agents mentioned above, metal salts of salicylic acid and its derivatives are preferably used.

Specific examples of the metal salts of salicylic acid derivatives include compounds having the following formula:

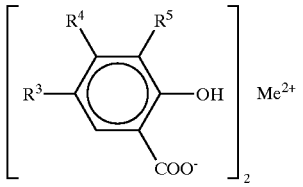

wherein $R^3$, $R^4$ and $R^5$ independently represent a hydrogen atom, an alkyl group having from 1 to 10 carbon atoms (preferably from 1 to 6) carbon atoms or an allyl group; and Me represents a metal selected from zinc, nickel, cobalt, copper or chrome.

The above-mentioned metal salts of salicylic acid derivatives can be easily formed, for example, by a method described in CLARK, J. L. Kao. H(1948) J. Amer. Chem. Soc. 70, 2151. For example, 2 moles of sodium salicylate (or a sodium salt of a salicylic acid derivative) and 1 mole of zinc chloride are mixed in a solvent, and the mixture is heated and agitated to form a zinc salt of salicylic acid (or salicylic acid derivative). The metal salt is a white crystal, and therefore even when the metal salt is dispersed in a binder resin, the mixture does not color. Metal salts other than zinc salts can also be prepared similarly to the above-mentioned method.

The weight ratio of a metal complex or metal salt of salicylic acid (or a salicylic acid derivative) to a binder resin is 0.1/100 to 10/100 by weight and preferably from 0.5/100 to 5/100 by weight.

Specific examples of the metal complexes or metal salts of salicylic acid (or salicylic acid derivatives) include the following compounds:

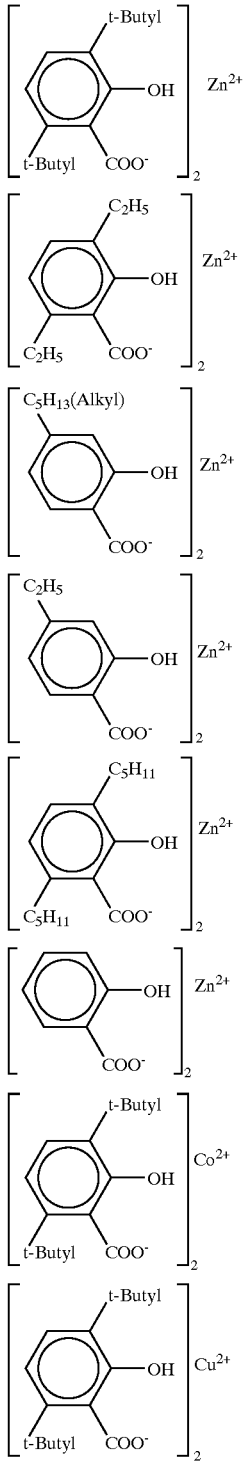

External Particulate Additive

Inorganic fine particles are typically used as an external particulate additive (hereinafter referred to as an external additive). Inorganic particulate materials having a primary particle diameter of from 5 nm to 2 $\mu$m, and preferably from 5 nm to 500 nm, are preferably used. The surface area of the inorganic particulate materials is preferably from 20 to 500 $m^2/g$ when measured by a BET method.

The content of the inorganic particulate material is preferably from 0.01% to 5.0% by weight, and more preferably from 0.01% to 2.0% by weight, based on the total weight of the toner.

Specific examples of such inorganic particulate materials include silica, alumina, titanium oxide, barium titanate, magnesium titanate, calcium titanate, strontium titanate, zinc oxide, tin oxide, quartz sand, clay, mica, sand-lime, diatom earth, chromium oxide, cerium oxide, red iron oxide, antimony trioxide, magnesium oxide, zirconium oxide, barium sulfate, barium carbonate, calcium carbonate, silicon carbide, silicon nitride, etc.

Particles of a polymer such as polystyrene, polymethacrylates, and polyacrylate copolymers, which are prepared by a polymerization method such as soap-free emulsion polymerization methods, suspension polymerization methods and dispersion polymerization methods; particles of a polymer such as silicone, benzoguanamine and nylon, which are prepared by a polymerization method such as polycondensation methods; and particles of a thermosetting resin can also be used as the external additive of the toner of the present invention.

The external additive is preferably subjected to a hydrophobizing treatment to prevent deterioration of the fluidity and charge properties of the resultant toner particularly under high humidity conditions. Suitable hydrophobizing agents for use in the hydrophobizing treatment include silicone oils, silane coupling agents, silylation agents, silane coupling agents having a fluorinated alkyl group, organic titanate coupling agents, aluminum coupling agents, etc.

In addition, the toner preferably includes a cleanability improving agent which can impart good cleaning property to the toner such that the toner remaining on the surface of an image bearing member such as a photoreceptor even after a toner image is transferred can be easily removed. Specific examples of such a cleanability improving agent include fatty acids and their metal salts such as stearic acid, zinc stearate, and calcium stearate; and particulate polymers such as polymethylmethacrylate and polystyrene, which are manufactured by a method such as soap-free emulsion polymerization methods.

Particulate resins having a relatively narrow particle diameter distribution and a volume average particle diameter of from 0.01 $\mu$m to 1 $\mu$m are preferably used in the toner of the present invention.

Method for Treating the Surface of Mother Toner Particles

In the present invention, the mother toner particles including a colorant and a binder resin as main components are then mixed with a charge controlling agent in a container using a rotor. Thus the resultant toner particles are charged. Specifically, mother toner particles and a charge controlling agent is contained in the agitator mentioned above, and then the mixture is mixed for a few seconds to tens of minutes by a rotor whose rotating speed is preferably from 40 to 150 m/s and more preferably from 60 to 120 m/s. This operation may be repeated to complete the treatment. When the mother toner particles used are strongly cohesive, it is preferable that only the mother toner particles are previously agitated by the rotor whose rotating speed is tens m/s and then a charge controlling agent is added to the mother toner particles such that the mixture is subjected to the mixing treatment.

The mixer for use in the mixing treatment will be explained referring to FIGS. 3 to 7.

Figure 3:
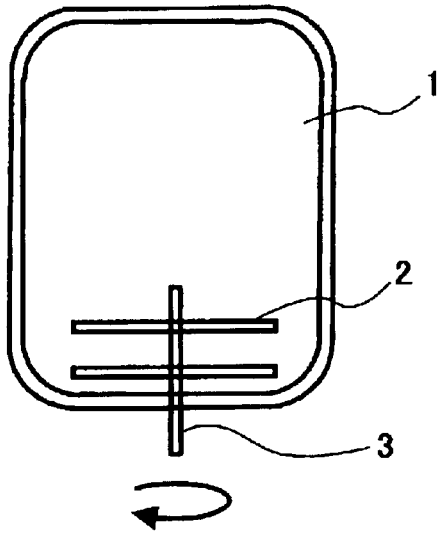
FIG. 3 BACKGROUND ART
FIGS. 3 and 8 are schematic views illustrating the cross sections of background art mixers.

FIG. 3 is a schematic view illustrating the cross section of a Henshel mixer which is conventionally used as a mixer. In FIG. 3, numerals 1, 2 and 3 denote a vessel, an agitating blade and a driving shaft.

Figure 4:
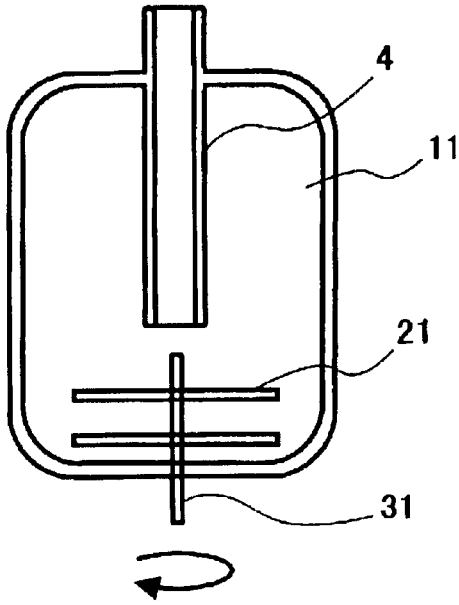
FIGS. 4 to 6 are schematic views illustrating embodiments of the mixer for use in the toner manufacturing method of the present invention.

FIG. 4 is a schematic view illustrating the cross section of an embodiment of the mixer for use in the present invention. In FIG. 4, numerals 4, 11, 21 and 31 denote a cylindrical member, a vessel, an agitating blade and a driving shaft.

In FIG. 4, the agitating blade 21 is arranged at a bottom portion of the vessel 11. The cylindrical member 4 is located at a position in an extension direction of the driving shaft 31. A mixture of mother toner particles with an additive such as charge controlling agents is agitated by the agitating blade 21. The scattered mixture is received by the outside wall of the cylindrical member, resulting in decrease of the kinetic energy of the mixture, and thereby the mixture falls toward the agitating blade 31 (i.e., the mixture is re-supplied to the agitating blade). By performing the mixing treatment using such a mixer, the additive can be uniformly mixed with the mother particles without causing the toner adhesion problem in which the toner adheres to the wall of the mixer, the shear stress decreasing problem and the mixture deposition problem.

Figure 5:
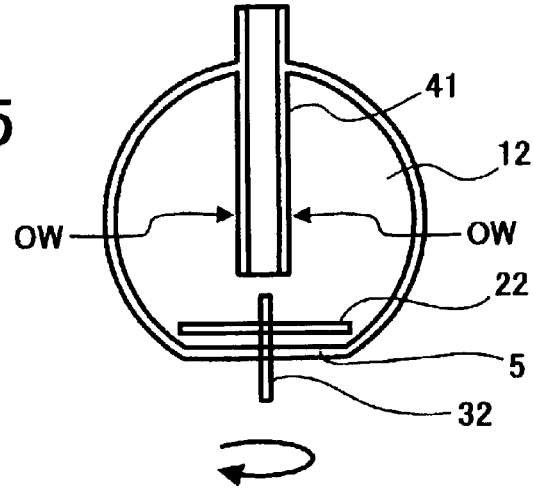

FIG. 5 is a schematic view illustrating the cross section of a Q-form mixer for use in the present invention. In FIG. 5, numerals 41, 12, 22, 32 and 5 denote a cylindrical member, a vessel, an agitating blade, a driving shaft, and a bottom of the vessel.

In FIG. 5, the bottom 5 of the vessel has a flat circular shape and the driving shaft 32 is arranged so as to vertically pass through the center of the bottom 5. The driving shat 32 has the agitating blade 22. The agitating blade 22 rotates to scatter a mixture of mother toner particles with an additive upwardly from the periphery of the bottom 5. The cylindrical member 41 is arranged in an extension direction of the driving shaft 32. The scattered mixture is received by an outside wall OW of the cylindrical member, resulting in decrease of the kinetic energy of the mixture, and thereby the mixture falls to the agitating blade 22 (i.e., the mixture is re-supplied toward the agitating blade 22). By performing the mixing treatment using such a mixer, the additives can be uniformly fixed on the mother particles, and thereby the resultant toner has good durability.

Since the inside wall of the vessel 12 is rounded, the mixture contacts the inside wall while moving along the inside wall (namely, the mixture is not vertically collided against the inside wall), the adhesion of the mixture on the inside wall can be prevented.

The cylindrical member 41 preferably has a circle or polygonal cross section to perform the function (namely, when the cylindrical member 41 has such a shape, the circled air is smoothly flown, and thereby the mixing treatment can be uniformly performed).

The central portion of the vessel 12 has a relatively low pressure compared to other portions thereof. Therefore, by discharging the shaft sealing air to the outside through the cylindrical member 41, the mixture tends not move into the cylindrical member 41. Therefore, uniform mixing can be performed.

Figure 6:
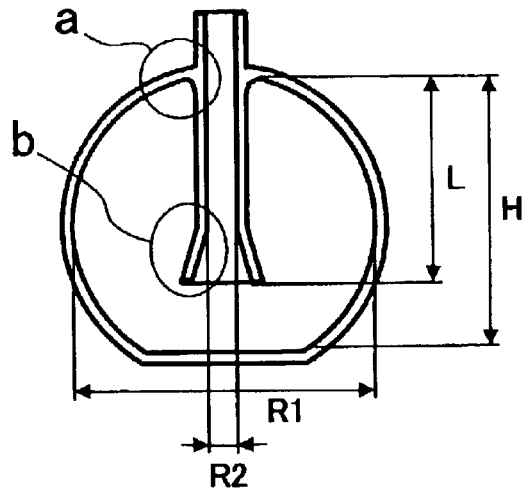

FIG. 6 is a schematic view illustrating another embodiment of the Q-form mixer for use in the present invention (the driving shaft and agitating blade are not illustrated). In FIG. 6, the neck (a) of the cylindrical member is rounded, and the tip (b) of the cylindrical member has a trumpet form. In FIG. 6, the height (H) and width (R1) of the vessel 12 and the length (L) and inside diameter (R2) of the cylindrical member 41 are defined.

In order that the cylindrical member 41 effectively functions, the height H of the vessel 12 and the length L of the cylindrical member 41 preferably satisfy the following relationship:

$$L \geqq H/10.$$

When the length L is too short, the mixture to be treated tends to move into the cylindrical member 41.

In addition, in order to prevent the shear stress decreasing problem (in order to uniformly performing the mixing treatment), the following relationship is preferably satisfied:

$$L \geqq H/3.$$

Further, the inside diameter R2 of the cylindrical member is preferably not smaller than R1/10. When the inside diameter is too small, the kinetic energy decreasing function is not fully exerted, and thereby the shear stress decreasing problem occurs.

When the tip portion of the cylindrical member 41 has a trumpet shape (b) as shown in FIG. 6, the effect of preventing the mixture from moving into the cylindrical member 41 can be further effectively exerted.

In addition, when the cylindrical member 41 has the rounded neck (a) as shown in FIG. 6, the mixture to be treated can be smoothly circulated, and thereby deposition of the mixture on the inside wall of the vessel 12 can be effectively prevented.

In the Q-form mixer as shown in FIG. 6, a mixture can be mixed while the agitating blade is rotated at a rotation speed of from 50 m/s to 150 m/s.

It is preferable to perform a preliminary mixing treatment in which mother toner particles including at least a resin and a colorant and an additive such as charge controlling agents are mixed at a rotation speed lower than 50 m/s, and then the mixing treatment is performed at a rotation speed not lower than 50 m/s. By using such a mixing method, the mixing treatment can be performed uniformly and in addition the resultant toner has good charge rising property. In addition, when a charge controlling agent having a weight average particle diameter not greater than 3 μm is used, a further uniform mixing treatment can be performed, and thereby the resultant toner has a further improved charge rising property.

Figure 7:
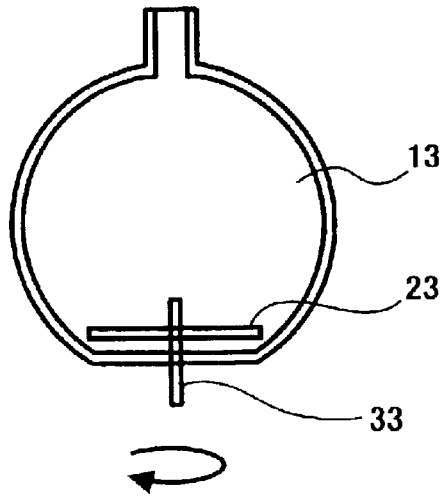
FIG. 7 is a schematic view illustrating the cross section of a comparative mixer used in Comparative Example 6.
Figure 8:
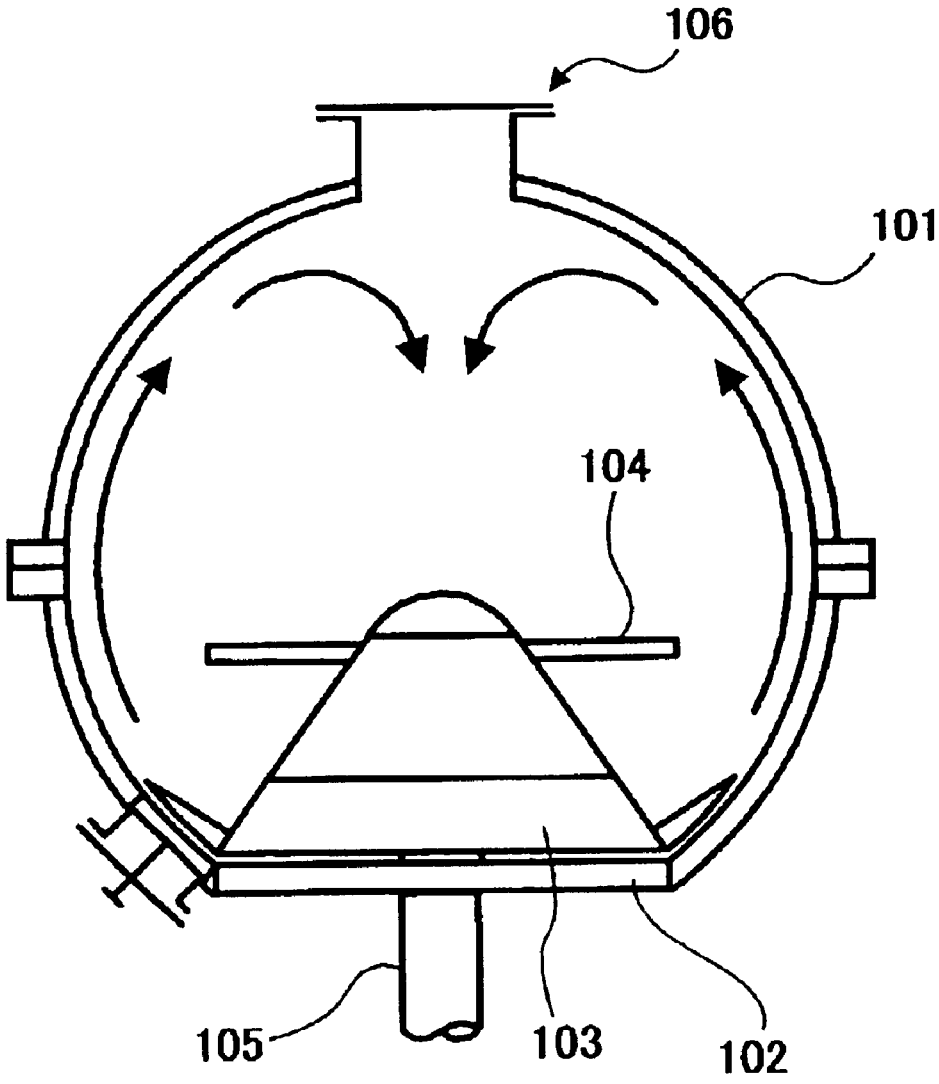
FIG. 8 BACKGROUND ART

FIG. 7 is a schematic view illustrating a comparative Q-form mixer used in Comparative Example 6 mentioned below. In FIG. 7, numerals 13, 23 and 33 denote a vessel, an agitating blade and a driving shaft.

In order to improve the fluidity of the toner, an external additive may be added in this mixing treatment. The timing of adding the external additive is as follows:

(1) an external additive is added to the mother toner particles before a charge controlling agent is added to the mother toner particles;

(2) an external additive is added to the mother toner particles together with a charge controlling agent;

(3) an external additive is added to the mother toner particles after a charge controlling agent is added to the mother toner particles; and (4) an external additive, which can improve the fluidity of the mother toner particles, is added to the mother toner particles together with a charge controlling agent, and then another external additive, which can improve the developing properties and transferring properties of the resultant toner, is added to the mixture.

Two Components Developer

The toner of the present invention can be used for a two-component developer in which the toner is mixed with a magnetic carrier. The weight ratio (T/C) of the toner (T) to the carrier (C) is preferably from 1/100 to 10/100.

Suitable carriers for use in the two component developer include known carrier materials such as iron powders, ferrite powders, magnetite powders, magnetic resin carriers, which have a particle diameter of from about 20 to about 200 μm. The surface of the carriers may be coated by a resin.

Specific examples of such resins to be coated on the carriers include amino resins such as urea-formaldehyde resins, melamine resins, benzoguanamine resins, urea resins, and polyamide resins, and epoxy resins. In addition, vinyl or vinylidene resins such as acrylic resins, polymethylmethacrylate resins, polyacrylonitirile resins, polyvinyl acetate resins, polyvinyl alcohol resins, polyvinyl butyral resins, polystyrene resins, styrene-acrylic copolymers, halogenated olefin resins such as polyvinyl chloride resins, polyester resins such as polyethyleneterephthalate resins and polybutyleneterephthalate resins, polycarbonate resins, polyethylene resins, polyvinyl fluoride resins, polyvinylidene fluoride resins, polytrifluoroethylene resins, polyhexafluoropropylene resins, vinylidenefluoride-acrylate copolymers, vinylidenefluoride-vinylfluoride copolymers, copolymers of tetrafluoroethylene, vinylidenefluoride and other monomers including no fluorine atom, and silicone resins.

If desired, an electroconductive powder may be included in the toner. Specific examples of such electroconductive powders include metal powders, carbon blacks, titanium oxide, tin oxide, and zinc oxide. The average particle diameter of such electroconductive powders is preferably not greater than 1 μm. When the particle diameter is too large, it is hard to control the resistance of the resultant toner.

The toner of the present invention can also be used as a one-component magnetic developer or a one-component non-magnetic developer.

Full Color Image Developing Method

When the toner of the present invention, which has the specific spherical degree and specific quantity ratio (M/T) of the charge controlling agent, is preferably used for full color image forming methods using non-magnetic one component developer and full color image forming methods using a two-component developer because uniform half-tone images can be produced.

In addition, the toner of the present invention can also be preferably used for image forming methods in which a toner image is first transferred on an intermediate transfer medium and then transferred onto a receiving material because high quality toner image can be transferred at a high transfer efficiency. Specifically, by repeating an image forming operation using color toners in which a color image (such as yellow, magenta, cyan and black images) formed on an image bearing member is transferred on a receiving material, a full color image is formed on the receiving material. In this case, at least one of the color toners is the toner of the present invention. The resultant full color image has good halftone reproducibility.

In this full color image forming method, a developing device having plural developing sections for forming plural color toner images is used. Each of the developing sections has a developing roller configured to bear a developer layer thereon and a regulating blade configured to control the thickness of the developer layer. Electrostatic latent images, which correspond to the respective color images and which are formed on the image bearing member one by one, are developed by the developing sections, resulting in formation of color toner images on the image bearing member one by one. The color toner image is then transferred on a receiving material one by one to form a full color image. The electrostatic latent images can be formed by, for example, charging a photoreceptor (i.e., image bearing member) with a charger using an electroconductive brush and then irradiating the photoreceptor with imagewise light.

The color toners may be transferred on an intermediate transfer medium to form a full color image thereon. The full color image is then transferred on a receiving material.

In the full color image forming method, plural image bearing members may be used to form the respective color toner image thereon. The plural color toner images are transferred on an intermediate transfer medium or a receiving material.

In the developing process, a reverse developing method is preferably used in which an electrostatic latent image is developed with a developer having a charge whose polarity is the same as that of the electrostatic latent image.

In addition, it is preferable that an electrostatic latent image on a photoreceptor is developed with a developer layer formed on the developing roller while the developer directly contacts the photoreceptor and the developing roller is rotated at a speed higher than that of the photoreceptor.

When the toner of the present invention is used for image forming apparatus having a corotron transfer device, the transferability of toner images can be improved. However, the effect of the toner can be fully exerted when the toner is used for image forming apparatus in which toner images are transferred from an image bearing member to a receiving material (or an intermediate transfer medium) while transfer means such as a transfer roller presses the receiving material (or an intermediate transfer medium) toward the image bearing member.

Having generally described this invention, further understanding can be obtained by reference to certain specific examples which are provided herein for the purpose of illustration only and are not intended to be limiting. In the descriptions in the following examples, the numbers represent weight ratios in parts, unless otherwise specified.

EXAMPLES

Example 1

Preparation of Cyan Toner

The following components were mixed and agitated in a flasher.

| | |
|---|---|
| Water | 600 |
| Pigment Blue 15:3 aqueous cake (solid content of 50%) | 1200 |

Then 1,200 parts of a polyester resin having an acid value of 3, a hydroxyl value of 25, a weight average molecular weight Mw of 15,000, a Mw/Mn ratio of 4.0, a peak molecular weight of 12,500 and a transition temperature of 60° C. were added to the mixture, and kneaded at 150° C. for 30 minutes. Then 1,000 parts of xylene were added thereto, and further kneaded for 1 hour. After water and xylene were removed therefrom, the residue was cooled by rolling and then pulverized by a pulverizer. Then the powder was kneaded twice by a three-roll mill. Thus a cyan pigment master batch was prepared.

Then the following components were mixed.

| | |
|---|---|
| The polyester resin mentioned above | 100 |
| The cyan pigment master batch prepared above | 3 |
| Zinc salicylate derivative serving as Charge controlling agent (BONTRON E-84 from Orient Chemical Industries Co., Ltd.) | 2.25 |
| Carnauba wax | 5 |

The mixture was mixed by a mixer and then melted and kneaded by a two-roll mill at 150° C. Then the mixture was cooled by rolling. The mixture was pulverized by a pulverizer (I TYPE MILL manufactured by Nippon Pneumatic Mfg. Co., Ltd.) which is a jet mill using a collision plate and in which compressed air of 4 kg/cm$^2$ is used. Then the pulverized mixture was air-classified by a classifier (DS CLASSIFIER manufactured by Nippon Pneumatic Mfg. Co., Ltd.) which uses circling air. Further the classified mixture was subjected to a sphering treatment using a SURFUSION SYSTEM manufactured by Hosokawa Micron at 250° C. while fed to the system at a speed of 1 kg/hr. Thus spherical colored toner particles (i.e., a mother toner) were prepared.

Then the following components were mixed in a Q type mixer manufactured by Mitsui Mining Co., Ltd.

| | |
|---|---|
| The mother toner prepared above | 100 |
| Charge controlling agent (BONTRON E-84) | 0.25 |

The mixing conditions were as follows:

Rotation speed of turbine blade: 50 m/s

Mixing operation: 5 cycles of a mixing operation for 2 minutes followed by a pause for 1 minute Then 0.5 parts of a hydrophobic silica (H2000 manufactured by Clariant Japan K. K. were added to the mixture and the mixture as an external additive was mixed in the Q mixer under the following conditions:

Thus, a cyan toner of Example 1 was prepared.

Example 2

The procedure for preparation of the toner in Example 1 was repeated except that the addition quantity of the charge controlling agent (i.e., BONTRON E-84) was changed from 0.25 to 0.50.

Thus, a cyan toner of Example 2 was prepared.

Example 3

The procedure for preparation of the toner in Example 1 was repeated except that the temperature of the sphering treatment was changed from 250° C. to 300° C.

Thus, a cyan toner of Example 3 was prepared.

Example 4

The procedure for preparation of the toner in Example 2 was repeated except that the temperature of the sphering treatment was changed from 250° C. to 300° C.

Thus, a cyan toner of Example 4 was prepared.

Example 5

The procedure for preparation of the toner in Example 1 was repeated except that the temperature of the sphering treatment was changed from 250° C. to 300° C. and the rotation speed of the turbine blade in the surface treatment was changed from 50 m/s to 160 m/s.

Thus, a cyan toner of Example 5 was prepared.

Example 6

The procedure for preparation of the toner in Example 1 was repeated except that the temperature of the sphering treatment was changed from 250° C. to 300° C. and the rotation speed of the turbine blade in the surface treatment was changed from 50 m/s to 80 m/s.

Thus, a cyan toner of Example 6 was prepared.

Example 7

The procedure for preparation of the toner in Example 1 was repeated except that the temperature of the sphering treatment was changed from 250° C. to 300° C. and the rotation speed of the turbine blade in the surface treatment was changed from 50 m/s to 120 m/s.

Thus, a cyan toner of Example 7 was prepared.

Example 8

The procedure for preparation of the toner in Example 4 was repeated except that the charge controlling agent of 2.25 parts was not included in the toner constituents mixture and the addition quantity of the charge controlling agent added in the mixing process was changed from 0.50 to 0.05.

Thus, a cyan toner of Example 8 was prepared.

Example 9

The procedure for preparation of the toner in Example 4 was repeated except that the charge controlling agent of 2.25 parts was not included in the toner constituents mixture and the addition quantity of the charge controlling agent added in the mixing process was changed from 0.50 to 0.25.

Thus, a cyan toner of Example 9 was prepared.

Example 10

The procedure for preparation of the toner in Example 4 was repeated except that the charge controlling agent of 2.25 parts was not included in the toner constituents mixture and the addition quantity of the charge controlling agent added in the mixing process was changed from 0.50 to 1.0.

Thus, a cyan toner of Example 10 was prepared.

Example 11

The procedure for preparation of the toner in Example 4 was repeated except that the air pressure in the pulverization process was increased from 4 kg/cm$^2$ to 6 kg/cm$^2$ and the speed of the circling air in the classification process was increased.

Thus, a cyan toner of Example 11 was prepared.

Example 12

The procedure for preparation of the toner in Example 4 was repeated except that the air pressure in the pulverization process was increased from 4 kg/cm$^2$ to 6 kg/cm$^2$.

Thus, a cyan toner of Example 12 was prepared.

Example 13

The procedure for preparation of the toner in Example 4 was repeated except that the air pressure in the pulverization process was increased from 4 kg/cm$^2$ to 5 kg/cm$^2$ and the speed of the circling air in the classification process was increased.

Thus, a cyan toner of Example 13 was prepared.

Example 14

The procedure for preparation of the toner in Example 4 was repeated except that the air pressure in the pulverization process was increased from 4 kg/cm$^2$ to 5 kg/cm$^2$.

Thus, a cyan toner of Example 14 was prepared.

Example 15

The following components were mixed with TK HOMOMIXER (manufactured by Tokushu Kika Kogyo Co., Ltd.) at 60° C., wherein the rotation speed of HOMOMIXER was 12,000 rpm to prepare a dispersant.

| | |
|---|---|
| Styrene | 165 |
| n-butyl acrylate | 35 |
| Pigment Blue 15:3 aqueous cake (solid content of 50%) | 10 |
| Styrene-methacrylic acid copolymer | 8 |
| Paraffin wax (melting point of 70° C.) | 20 |

Ten (10) parts of 2,2'-azobis(2,4-valeronitrile) was added to the dispersion to be dissolved therein. Thus a polymerizable monomer composition was prepared.

On the other hand, 450 parts of 0.1M sodium phosphate were added to 710 parts of deionized water. Then 68 parts of 1.0 M calcium chloride were gradually added to the mixture while the mixture was agitated by a TK HOMOMIXER at a rotation speed of 13,000 rpm to prepare a suspension in which tricalcium phosphate is dispersed.

The polymerizable monomer composition was added to the suspension and the mixture was agitated for 20 minutes by a TK HOMOMIXER at a rotation speed of 10,000 rpm to form particles of the polymerizable monomer composition. The thus prepared dispersion was contained in a reaction vessel having a stirrer, and then reacted at a temperature of from 75 to 95° C. for 5 to 15 hours. Then hydrochloric acid was added thereto to dissolve and remove tricalcium phosphate therefrom. Further, the dispersion was subjected to a classification treatment using a centrifugal separator to classify the particles in a liquid phase using a centrifugal sedimentation method. Then the dispersion was filtered, and the cake was washed and then dried to prepare a colored particulate material.

Then the following components were mixed in a Q type mixer manufactured by Mitsui Mining Co., Ltd.

| | |
|---|---|
| The colored particulate material prepared above | 100 |
| Charge controlling agent (BONTRON E-84) | 0.25 |

The mixing conditions were as follows:

Rotation speed of turbine blade: 80 m/s

Mixing operation: 5 cycles of a mixing operation for 2 minutes followed by a pause for 1 minute Then 0.5 parts of a hydrophobic silica (H2000 manufactured by Clariant Japan K. K. were added to the mixture and the mixture was mixed in the Q mixer under the following conditions:

Rotation speed of turbine blade: 15 m/s

Mixing operation: 5 cycles of a mixing operation for 30 seconds followed by a pause for 1 minute Thus, a cyan toner of Example 15 was prepared.

Example 16

Toner Manufacturing Method using a Urea-Modified Resin (Preparation of Toner Binder)

In a reaction container having a condenser, a stirrer and a pipe from which a nitrogen gas was supplied to the container, 724 parts of an adduct of bisphenol A with 2 moles of ethyleneoxide, 276 parts of isophthalic acid and 2 parts of dibutyl tin oxide were added to the container. Then the mixture was reacted for 8 hours at 230° C. under a normal pressure. Then the reaction was further performed for 5 hours under a reduced pressure of from 10 to 15 mmHg. After the reaction product was cooled to 160° C., 32 parts of phthalic acid anhydride were added thereto to further perform a reaction for 2 hours. Then the reaction product was cooled to 80° C. The reaction product was mixed with 188 parts of isophorondiisocyanate in ethyl acetate and reacted for 2 hours to prepare a prepolymer having an isocyanate group.

Then 267 parts of the thus synthesized prepolymer were reacted with 14 parts of isophoronediamine for 2 hours at 50° C. Thus, a urea-modified polyester (1) having a weight average molecular weight of 64,000 was prepared.

Similarly, 724 parts of an adduct of bisphenol A with 2 moles of ethyleneoxide and 276 parts of terephthalic acid were condensation-polymerized for 8 hours at 230° C. under a normal pressure. Then the reaction was further performed for 5 hours under a reduced pressure of from 10 to 15 mmHg to prepare an unmodified polyester (2) having a peak molecular weight of 5,000.

Then 200 parts of the urea-modified polyester (1) and 800 parts of the polyester (2) were dissolved in 2,000 parts of a mixture solvent of ethyl acetate and methyl ethyl ketone (1/1 in weight ratio) to prepare a solution of mixed polyesters (1) and (2). A part of the solution was dried to prepare a solid polyester mixture. The glass transition temperature was 62° C.

(Preparation of colored particles)

In a beaker, 240 parts of the solution of mixed polyesters (1) and (2), 20 parts of pentaerythritol tetrabehenate having a melting point of 81° C. and a melt viscosity of 25 cps and 4 parts of copper phthalocyanine blue pigment were contained. The mixture was agitated by a TK HOMOMIXER at a revolution of 12,000 rpm to prepare a dispersion.

On the other hand, 706 parts of deionized water, 294 parts of 10% suspension of hydroxyapatite (SUPERTITE 10 manufactured by Nippon Chemical Industrial Co., Ltd.) and 0.2 parts of sodium dodecylbenzenesulfonate were added in a container to prepare a solution. The mixture was heated to 60° C., and then the above-prepared dispersion was added thereto while the mixture was agitated for 10 minutes by a TK HOMOMIXER at a revolution of 12,000 rpm. Then the mixture was contained in a container having a stirrer and a thermometer and heated to 80° C. to remove the mixture solvent of ethyl acetate and methyl ethyl ketone. Then the dispersion was filtered, washed with hydrochloric acid, washed with water, dried, and classified to prepare colored particles.

Then the following components were mixed in a Q type mixer manufactured by Mitsui Mining Co., Ltd.

| | |
|---|---|
| The colored particles prepared above | 100 |
| Charge controlling agent (BONTRON E-84) | 0.25 |

The mixing conditions were as follows:

Rotation speed of turbine blade: 100 m/s

Mixing operation: 5 cycles of a mixing operation for 2 minutes followed by a pause for 1 minute Then 0.5 parts of a hydrophobic silica (H2000 manufactured by Clariant Japan K. K. were added to the mixture and the mixture was mixed in the Q mixer under the following conditions:

Rotation speed of turbine blade: 15 m/s

Mixing operation: 5 cycles of a mixing operation for 30 seconds followed by a pause for 1 minute Thus, a cyan toner of Example 16 was prepared.

Comparative Example 1

The procedure for preparation of the toner in Example 1 was repeated except that the rotation speed of the turbine blade in the surface treatment was changed from 50 m/s to 30 m/s.

Thus a cyan toner of Comparative Example 1 was prepared.

Comparative Example 2

The procedure for preparation of the toner in Example 1 was repeated except that the addition quantity of the charge controlling agent was changed from 2.25 to 1.25 in the toner constituents mixture, the addition quantity of the charge controlling agent added in the mixing process was changed from 0.25 to 1.25, and the rotation speed of the turbine blade in the surface treatment was changed from 50 m/s to 160 m/s.

Thus a cyan toner of Comparative Example 2 was prepared.

Comparative Example 3

The procedure for preparation of the toner in Example 1 was repeated except that the temperature of the sphering treatment was changed from 250° C. to 200° C.

Thus, a cyan toner of Comparative Example 3 was prepared.

Comparative Example 4

The procedure for preparation of the toner in Example 1 was repeated except that the temperature of the sphering treatment was changed from 250° C. to 350° C.

Thus, a cyan toner of Comparative Example 4 was prepared.

The manufacturing conditions of the toners of Examples 1 to 16 and Comparative Examples 1 to 4 are shown in Table

1.

TABLE 1

| | Manifac-turing method | Sphering treatment Temp. (° C.) | Charge controlling agent (CCA) Internal CCA (Wt. %) | External CCA (Wt. %) | Surface treatment Rotation speed (m/s) |
|---|---|---|---|---|---|
| Ex. 1 | PUL/CL* | 250 | 2.25 | 0.25 | 50 |
| Ex. 2 | PUL/CL* | 250 | 2.25 | 0.50 | 50 |
| Ex. 3 | PUL/CL* | 300 | 2.25 | 0.25 | 50 |
| Ex. 4 | PUL/CL* | 300 | 2.25 | 0.50 | 50 |
| Ex. 5 | PUL/CL* | 300 | 2.25 | 0.25 | 160 |
| Ex. 6 | PUL/CL* | 300 | 2.25 | 0.25 | 80 |
| Ex. 7 | PUL/CL* | 300 | 2.25 | 0.25 | 120 |
| Ex. 8 | PUL/CL* | 250 | 0 | 0.05 | 50 |
| Ex. 9 | PUL/CL* | 250 | 0 | 0.25 | 50 |
| Ex. 10 | PUL/CL* | 250 | 0 | 1.00 | 50 |
| Ex. 11 | PUL/CL* | 250 | 2.25 | 0.25 | 50 |
| Ex. 12 | PUL/CL* | 250 | 2.25 | 0.25 | 50 |
| Ex. 13 | PUL/CL* | 250 | 2.25 | 0.25 | 50 |
| Ex. 14 | PUL/CL* | 250 | 2.25 | 0.25 | 50 |
| Ex. 15 | SUS-POL** | — | 0 | 0.25 | 80 |
| Ex. 16 | POL-SUS3* | — | 0 | 0.25 | 100 |
| Comp. Ex. 1 | PUL/CL* | 250 | 2.25 | 0.25 | 30 |
| Comp. Ex. 2 | PUL/CL* | 250 | 2.25 | 0.25 | 160 |
| Comp. Ex. 3 | PUL/CL* | 200 | 2.25 | 0.25 | 50 |
| Comp. Ex. 4 | PUL/CL* | 350 | 2.25 | 0.25 | 50 |

PUL/CL*: Toner particles are prepared by a pulveirization/classification method.
SUS-POL**: Toner particles are prepared by a suspension polymerization method.
POL-SUS3*: Toner particles are prepared by a polymer suspension method.

When the toner of Example 1 was subjected to a fluorescent X-ray analysis to determine the quantity of the charge controlling agent in the toner by detecting Zn in the charge controlling agent, the quantity of the charge controlling agent was 2.51% by weight of the toner. Since the content of Zn in the charge controlling agent is 11.6% by weight, the value T of Zn was 0.291% (i.e., 2.51×0.116) by weight.

When the toner of Example 1 was subjected to an X-ray Photoelectron Spectroscopy (XPS) analysis, the contents of the elements present on the surface of the toner were as follows:

C: 83.9 atomic %, N: 0.93 atomic %, O: 12.6 atomic %, Cl: 0.94 atomic %, and Zn: 1.63 atomic %.

Therefore the value M of Zn (i.e., the content of Zn on the surface of the toner on a weight basis) is 7.83% by weight (i.e., the value M is calculated by weighting the above-described contents of the elements with their molecular weights). Therefore the ratio (M/T) of the charge controlling agent is determined to be 27.

The wide XPS spectrum of the toner is illustrated in FIG. 1, and the narrow spectra thereof are illustrated in FIGS. 2A to 2E. As can be understood from FIG. 1, a large amount of C and O are present on the surface of the toner particles, and a small amount of Zn, N and Cl are present on the surface of the toner particles. FIGS. 2A to 2E illustrate the enlarged peaks of C1s, O1s, N1s, C12p and Zn2p3. In FIGS. 2A to 2E, the chemical states of the elements (i.e., the groups to which the elements belong) are also shown. The above-mentioned concentrations of the elements on the surface of the toner particles are calculated using these peaks and their relative sensitivity factors presented by PHI.

Similarly, the content (CCA content 1) of the charge controlling agent at the surface of the toner particles and the content (CCA content 2) of the charge controlling agent in the toner particles of Examples 2 to 16 and Comparative Examples 1 to 4 were determined. In addition, the following qualities of the toners were measured.

(1) Spherical degree (SD)

The method for measuring the spherical degree is mentioned above.

(2) Charge rising property (CR)

The method for measuring the charge rising property is mentioned above.

(3) Volume average particle diameter (Dv)

The method for measuring the volume average particle diameter is mentioned above.

(4) Ratio (Dv/Dn) of volume average particle diameter (Dv) to number average particle diameter (Dn)

The method for measuring the ratio is mentioned above.

The results are shown in Table 2.

TABLE 2

| | SD | CCA content 1 (wt %) | CCA content 2 (atom %) | M/T | CR | Dv (μm) | Dv/Dn |
|---|---|---|---|---|---|---|---|
| Ex. 1 | 0.962 | 2.51 | 1.63 | 27 | 0.55 | 9.3 | 1.31 |
| Ex. 2 | 0.965 | 2.50 | 5.95 | 98 | 0.62 | 9.1 | 1.33 |
| Ex. 3 | 0.975 | 2.49 | 8.86 | 147 | 0.51 | 8.6 | 1.28 |
| Ex. 4 | 0.976 | 2.55 | 20.9 | 340 | 0.45 | 8.2 | 1.35 |
| Ex. 5 | 0.980 | 2.48 | 23.2 | 387 | 1.35 | 8.6 | 1.25 |
| Ex. 6 | 0.973 | 2.47 | 25.3 | 424 | 0.75 | 8.3 | 1.26 |
| Ex. 7 | 0.972 | 2.50 | 23.9 | 395 | 1.15 | 8.9 | 1.30 |
| Ex. 8 | 0.978 | 0.05 | 0.26 | 216 | 0.25 | 8.8 | 1.28 |
| Ex. 9 | 0.972 | 0.24 | 3.00 | 517 | 0.45 | 9.5 | 1.26 |
| Ex. 10 | 0.970 | 1.01 | 18.5 | 757 | 0.68 | 9.0 | 1.30 |
| Ex. 11 | 0.976 | 2.50 | 20.8 | 345 | 0.55 | 5.5 | 1.18 |
| Ex. 12 | 0.973 | 2.53 | 18.3 | 299 | 0.45 | 5.3 | 1.25 |
| Ex. 13 | 0.979 | 2.47 | 23.1 | 387 | 0.62 | 7.5 | 1.17 |
| Ex. 14 | 0.975 | 2.48 | 20.1 | 335 | 0.33 | 7.7 | 1.26 |
| Ex. 15 | 0.980 | 0.26 | 4.55 | 724 | 0.92 | 5.1 | 1.15 |
| Ex. 16 | 0.985 | 0.25 | 4.55 | 753 | 0.99 | 4.0 | 1.13 |
| Comp. Ex. 1 | 0.963 | 2.52 | 0.20 | 8 | 0.34 | 8.3 | 1.31 |
| Comp. Ex. 2 | 0.964 | 2.49 | 69.7 | 1158 | 0.55 | 8.6 | 1.28 |
| Comp. Ex. 3 | 0.953 | 2.50 | 3.33 | 55 | 0.45 | 9.0 | 1.29 |
| Comp. Ex. 4 | 0.992 | 2.48 | 5.51 | 92 | 0.62 | 8.8 | 1.30 |

Method for evaluating image qualities

Evaluation of image qualities of the toners were performed using a full color laser printer, IPSIO 5000 (hereinafter referred to as an evaluation machine A), which is manufactured by Ricoh Co., Ltd. In the full color laser printer, four color images formed on a belt photoreceptor one by one using a developing device having four color developing sections are transferred on an intermediate transfer medium to form a full color toner image thereon. The full color toner image is then transferred on a receiving material.

In addition, the image qualities are evaluated using a full color LED printer GL8300 (hereinafter referred to as an evaluation machine B) manufactured by Fujitsu Ltd. In the printer, four color toner images were formed on four drum-shaped photoreceptors, respectively, using a developing device having four color developing sections.

Each of the developing sections of the laser printer and LED printer is a non-magnetic one-component developing unit having a developing roller made of an elastic material and a stainless blade regulating the thickness of the toner layer on the developing roller. The developing method was a reverse developing method in which the polarity of the developer is the same as that of electrostatic latent images formed on the photoreceptor. The electrostatic latent images are developed with the toner on the developing roller, which is rotated, while the latent images contact the toner. The rotation speed of the developing roller is faster (by 1.5 times or 1.2 times, respectively) than that of the photoreceptor.

The images were evaluated with respect to transferability, background fouling, haze factor, and fine line reproducibility.

(1) Transferability

When toner images of a toner having poor transferability are transferred on a thick paper, the toner images are not fully transferred on the thick paper (i.e., the possibility of image transfer is low) because the toner images are pressed when transferred. In particular, this problem tends to occur when line images and character images are formed.

Therefore, the transferability of a toner was evaluated as follows:

1) each of the cyan toners was set in each printer and subjected to a running test in which 10,000 images of an original image having an image area of 5% and an A4 size were formed; and
2) then character images 機械 having a size of 10 point are continuously formed (19 words per line) on a post card.

The characters were observed to determine the number of the characters having an omission. The transferability is graded as follows:

| | |
|---|---|
| Rank 5: | excellent |
| Rank 4: | good |
| Rank 3: | fair |
| Rank 2: | bad |
| Rank 1: | seriously bad |

(2) Background Density (BD)

At the beginning of the running test and after the running test, the toner remaining on the photoreceptor after the developing process was transferred on an adhesive tape. The reflection density (D1) of the tape having the toner and the density (D0) of the tape having no toner were measured by a SPECTRODENSITOMETER 938 manufactured by X-Rite to determine the density difference (D1–D0) (i.e., the background density).

When a toner having a poor charge rising property is used, the initial images tend to have a high background density. When a toner whose charge property deteriorates when used for a long time or which contaminates chargers is used, the background density increases after the running test.

(3) Haze Factor

A cyan image formed on an overhead projection sheet type PPC-DX manufactured by Ricoh Co., Ltd. The fixing temperature was 160° C. The haze factor of the cyan image was measured by a direct reading HAZE FACTOR COMPUTER HGM-2DP manufactured by Suga Test Instruments Co., Ltd.

The haze factor is called cloudiness, and the lower the haze factor of an image, the better the transparency of the image. The haze factor of a color image is preferably not greater than 30%, and more preferably not greater than 25%.

(4) Fine Line Reproducibility

After the running test, fine line images having a density of 600 dpi are formed. The images were observed to determine whether the images are blurred. The images were classified into the following five grades:

| | |
|---|---|
| Rank 5: | excellent |
| Rank 4: | good |
| Rank 3: | fair |
| Rank 2: | bad |
| Rank 1: | seriously bad |

The results are shown in Table 3.

TABLE 3

| | Transfer-ability (rank) | Background density: At the beginning | Background density: After the running test | Haze factor (%) | Fine line reproduc-ibility (rank) |
|---|---|---|---|---|---|
| Ex. 1 | 3 | 0.05 | 0.23 | 45 | 1 |
| | 2 | 0.04 | 0.22 | 36 | 1 |
| Ex. 2 | 3 | 0.01 | 0.21 | 65 | 2 |
| | 2 | 0.03 | 0.25 | 55 | 2 |
| Ex. 3 | 4 | 0.01 | 0.15 | 55 | 2 |
| | 3 | 0.02 | 0.16 | 46 | 2 |
| Ex. 4 | 4 | 0.06 | 0.22 | 78 | 1 |
| | 3 | 0.07 | 0.22 | 68 | 1 |
| Ex. 5 | 4 | 0.28 | 0.15 | 68 | 2 |
| | 4 | 0.22 | 0.16 | 59 | 1 |
| Ex. 6 | 4 | 0.06 | 0.07 | 46 | 1 |
| | 3 | 0.07 | 0.09 | 36 | 2 |
| Ex. 7 | 4 | 0.07 | 0.01 | 52 | 2 |
| | 3 | 0.08 | 0.01 | 48 | 2 |
| Ex. 8 | 4 | 0.07 | 0.24 | 13 | 2 |
| | 3 | 0.08 | 0.26 | 11 | 2 |
| Ex. 9 | 4 | 0.04 | 0.11 | 19 | 1 |
| | 4 | 0.03 | 0.20 | 15 | 1 |
| Ex. 10 | 4 | 0.02 | 0.08 | 26 | 1 |
| | 3 | 0.01 | 0.13 | 22 | 1 |
| Ex. 11 | 4 | 0.09 | 0.25 | 55 | 4 |
| | 4 | 0.10 | 0.28 | 48 | 5 |
| Ex. 12 | 4 | 0.08 | 0.23 | 48 | 3 |
| | 3 | 0.07 | 0.20 | 39 | 4 |
| Ex. 13 | 4 | 0.03 | 0.28 | 62 | 4 |
| | 3 | 0.03 | 0.26 | 58 | 3 |
| Ex. 14 | 4 | 0.07 | 0.30 | 68 | 3 |
| | 4 | 0.06 | 0.36 | 67 | 2 |
| Ex. 15 | 5 | 0.01 | 0.01 | 20 | 4 |
| | 4 | 0.02 | 0.02 | 15 | 5 |
| Ex. 16 | 5 | 0.00 | 0.00 | 11 | 5 |
| | 5 | 0.00 | 0.01 | 9 | 5 |
| Comp. | 3 | 0.33 | 0.28 | 68 | 1 |
| Ex. 1 | 2 | 0.40 | 0.33 | 66 | 1 |
| Comp. | 3 | Cannot be evaluated** | | 74 | 1 |
| Ex. 2 | 2 | | | 82 | 1 |
| Comp. | 1 | 0.08 | 0.33 | 77 | 2 |
| Ex. 3 | 1 | 0.10 | 0.44 | 77 | 2 |
| Comp. | Cannot be | 0.09 | 0.28 | 65 | 1 |
| Ex. 4 | evaluated* | 0.12 | 0.33 | 56 | 1 |

*the image cannot be evaluated because the image are seriously fogged.
**the image cannot be evaluated because the image has too low image density.

In Table 3, the upper numerals are of the images produced by the evaluation machine A and lower numerals are of the images produced by the evaluation machine B.

As can be understood from Table 3, the toners having a spherical degree and a M/T ratio in the specific ranges of the present invention, respectively, have good transferability and low background density. When the charge rising property of the toner is in the specific range of the present invention, the resultant images have low background density. In addition, when the toners do not have a charge controlling agent in the toner particles, the toner images have good transparency when the toner images are fixed. Further when the toners have a particle diameter and a particle diameter distribution in the specific ranges of the present invention, respectively, the toner images have good fine line reproducibility.

These properties of the toner prepared by the polymer suspension method (i.e., the toner of Example 16) are excellent. This is because the spherical degree, particle diameter distribution of the toner fall in the preferable ranges and the toner particles are subjected to a surface treatment of the present invention while the charge controlling agent is not included in the toner particles.

The following experiments were performed to check the effect of the method for manufacturing a toner using a mixer as illustrated in FIGS. 4-6.

Manufacturing Example 1

Preparation of Pigment Master Batch

The following components were mixed and agitated in a flasher.

| | |
|---|---|
| Water | 600 |
| Pigment Blue 15:3 aqueous cake (solid content of 50%) | 1200 |

Then 1,200 parts of a polyester resin having an acid value of 3, a hydroxyl value of 25, a weight average molecular weight Mw of 45,000, a Mw/Mn ratio of 4.0, and a transition temperature of 60° C. were added to the mixture, and kneaded at 150° C. for 30 minutes. Then 1,000 parts of xylene were added thereto, and further kneaded for 1 hour. After water and xylene were removed therefrom, the residue was cooled by rolling and then pulverized by a pulverizer. Then the powder was kneaded twice by a three-roll mill. Thus a cyan pigment master batch was prepared.

Preparation of Mother Toner

Then the following components were mixed.

| | |
|---|---|
| Polyester resin A (acid value of 35 mg KOH/g) | 90 |
| The cyan pigment master batch prepared above | 5 |

The mixture was mixed by a mixer and then melted and kneaded by a two-roll mill. Then the mixture was cooled by rolling. The mixture was pulverized by a pulverizer (I-2 TYPE MILL manufactured by Nippon Pneumatic Mfg. Co., Ltd.) which is a jet mill using a collision plate. Then the pulverized mixture was air-classified by a classifier (DS CLASSIFIER manufactured by Nippon Pneumatic Mfg. Co., Ltd.) which uses circling air. Thus colored particles (i.e., a cyan mother toner) having a weight average particle diameter of 6.5 $\mu$m were prepared.

Preparation of Toner

Then the following components were mixed in a Henshel mixer having a construction as shown in FIG. 4.

| | |
|---|---|
| The mother toner prepared above | 100 |
| Charge controlling agent (BONTRON E-84) | 0.1 |

The mixing conditions were as follows:

Rotation speed of blade: 30 m/s

Mixing operation: 3 cycles of a mixing operation for 2 minutes followed by a pause for 1 minute In addition, the height (H) and width (R1) of the Henshel mixer and the length (L) and inside diameter (R2) of the cylindrical member of the Henshel mixer were as follows:

H: 300 mm, L: 160 mm, R1: 300 mm and R2: 80 mm.

Thus, a cyan toner of Manufacturing Example 1 was prepared.

Comparative Manufacturing Example 1

The procedure for preparation of the toner in Manufacturing Example 1 was repeated except that the Henshel mixer was changed to a Henshel mixer having a construction as shown in FIG. 3.

The height (H) and width (R1) of the Henshel mixer were 300 mm and 300 mm, respectively.

Thus, a cyan toner of Comparative Manufacturing Example 1 was prepared.

Manufacturing Example 2

The procedure for preparation of the toner in Manufacturing Example 1 was repeated except that the Henshel mixer was changed to a Q-form mixer having a construction as shown in FIG. 5.

The conditions of the Q-form mixer were as follows:

Rotation speed of agitating blade: 100 m/s

Mixing operation: 3 cycles of a mixing operation for 2 minutes followed by a pause for 1 minute In addition, the height (H) and width (R1) of the Q-form mixer and the length (L) and inside diameter (R2) of the cylindrical member of the Q-form mixer were as follows:

H: 300 mm, L: 160 mm, R1: 350 mm and R2: 80 mm.

Thus, a cyan toner of Manufacturing Example 2 was prepared.

Comparative Manufacturing Example 2

The procedure for preparation of the toner in Manufacturing Example 2 was repeated except that the Q-form mixer was changed to a Q-form mixer having a construction as shown in FIG. 7.

The height (H) and width (R1) of the Q-form mixer were 300 mm and 350 mm, respectively.

Thus, a cyan toner of Comparative Manufacturing Example 2 was prepared.

Manufacturing Example 3

The procedure for preparation of the toner in Manufacturing Example 2 was repeated except that the cylindrical member 41 of the Q-form mixer was changed to a trumpet type member (b) as shown in FIG. 6.

Thus, a cyan toner of Manufacturing Example 3 was prepared.

Manufacturing Example 4

The procedure for preparation of the toner in Manufacturing Example 2 was repeated except that the cylindrical member 41 of the Q-form mixer was changed so as to have a round neck (a) as shown in FIG. 6.

Thus, a cyan toner of Manufacturing Example 4 was prepared.

Manufacturing Example 5

The procedure for preparation of the toner in Manufacturing Example 4 was repeated except that the rotation speed of the blade was changed from 100 to 150 m/s.

Thus, a cyan toner of Manufacturing Example 5 was prepared.

Manufacturing Example 6

The procedure for preparation of the toner in Manufacturing Example 5 was repeated except that the mother toner and charge controlling agent were preliminarily mixed by the Q-form mixer before the mixing using the Q-form mixer.

The mixing conditions of the preliminary mixing were as follows:

Rotation speed of blade: 40 m/s

Mixing time: 2 minutes

Thus, a cyan toner of Manufacturing Example 6 was prepared.

Manufacturing Example 7

The procedure for preparation of the toner in Manufacturing Example 2 was repeated except that the length (L) of the cylindrical member of the Q-form mixer was changed from 160 mm to 25 mm.

Thus, a cyan toner of Manufacturing Example 7 was prepared.

Manufacturing Example 8

The procedure for preparation of the toner in Manufacturing Example 2 was repeated except that the inside diameter (R2) of the cylindrical member of the Q-form mixer was changed from 80 mm to 25 mm.

Thus, a cyan toner of Manufacturing Example 8 was prepared.

Manufacturing Example 9

The procedure for preparation of the toner in Manufacturing Example 2 was repeated except that the rotation speed of the blade of the Q-form mixer was changed from 100 mm to 30 m/s.

Thus, a cyan toner of Manufacturing Example 9 was prepared.

Manufacturing Example 10

The procedure for preparation of the toner in Manufacturing Example 6 was repeated except that the particle diameter of the charge controlling agent was changed from 1.2 μm to 5 μm.

Thus, a cyan toner of Manufacturing Example 10 was prepared.

Evaluation Method

Each of the toners of Manufacturing Examples 1 to 10 and Comparative Manufacturing Examples 1 and 2 was evaluated with respect to the following properties.

(1) Weight of Obtained Toner (W)

The weight of a toner discharged from the mixer was checked when 1 kg of a mother toner was treated for 10 seconds while the blade was rotated at a revolution of 20 m/s.

(2) Q/M(15s)

One hundred parts of a silicone-coated ferrite carrier having an average particle diameter of 50 μm, and 2.5 parts of a toner were contained in a stainless pot such that the carrier and the toner occupy one-third of the volume of the container. Then the mixture was agitated for 15 seconds at a revolution of 100 rpm. Then Q/M of the toner was measured by a blow-off method.

(2) Q/M(10 m)

One hundred parts of a silicone-coated ferrite carrier having an average particle diameter of 50 μm, and 2.5 parts of a toner were contained in a stainless pot such that the carrier and the toner occupy one-third of the volume of the container. Then the mixture was agitated for 10 minutes at a revolution of 100 rpm. Then Q/M of the toner was measured by a blow-off method.

(4) Charge Rising Property (CR)

The charge rising property of a toner was calculated as follows.

$$CR\ (\%)=\{Q/M(15\ s)\}\times 100/\{Q/M(10\ m)\}$$

(5) Background Density (BD)

The background density was measured in the same way as mentioned above except that the image forming apparatus was changed to IMAGIO 6550.

(6) Durability of Toner

A running test was performed using a copier IMAGIO MF6550 manufactured by Ricoh Co., Ltd. and an original image having an image area of 5% and an A4 size. A cyan solid image was formed after every 1,000 copies. The image density of the solid image was measured by a spectrodensitometer 938 manufactured by X-Rite. It was judged that the life of a toner expired when the image density became 80% or less of the initial image density.

The results are shown in Table 4.

TABLE 4

| | W (g) | Q/M(15 s) | Q/M(10 m) | CR (%) | BD | Durability |
|---|---|---|---|---|---|---|
| Mfg. Ex. 1 | 712 | −21.3 | −23.4 | 91 | 0.09 | 2,000 |
| Mfg. Ex. 2 | 780 | −23.5 | −23.4 | 100 | 0.02 | 151,000 |
| Mfg. Ex. 3 | 820 | −28.2 | −27.6 | 102 | 0.01 | 160,000 |
| Mfg. Ex. 4 | 850 | −28.4 | −28.6 | 99 | 0.01 | 158,000 |
| Mfg. Ex. 5 | 865 | −26.9 | −27.1 | 99 | 0.01 | 183,000 |
| Mfg. Ex. 6 | 854 | −28.4 | −27.1 | 105 | 0.01 | 206,000 |
| Comp. Mfg. Ex. 1 | 631 | −18.2 | −25.4 | 72 | 0.17 | 1,000 |
| Comp. Mfg. Ex. 2 | 520 | −18.7 | −26.2 | 71 | 0.03 | 60,000 |
| Mfg. Ex. 7 | 680 | −23.7 | −25.2 | 94 | 0.05 | 80,000 |
| Mfg. Ex. 8 | 675 | −24.1 | −23.5 | 103 | 0.06 | 75,000 |
| Mfg. Ex. 9 | 853 | −13.8 | −24.3 | 57 | 0.05 | 5,000 |
| Mfg. Ex. 10 | 860 | −12.4 | −26.1 | 48 | 0.18 | 80,000 |

As can be understood from Table 4, the toners prepared by the method of the present invention have good charging properties and image quality. In particular, the toners of Manufacturing Examples 2 to 6 have good charging properties, image quality and durability. In addition, the toners can be manufactured at a high yield.

This document claims priority and contains subject matter related to Japanese Patent Applications Nos. 2001-87924 and 2001-65366, filed on Mar. 26, 2001 and Mar. 8, 2001, respectively, incorporated herein by reference.

Having now fully described the invention, it will be apparent to one of ordinary skill in the art that many changes and modifications can be made thereto without departing from the spirit and scope of the invention as set forth therein.

What is claimed as new and desired to be secured by Letters Patent of the United States is:

1. A toner composition comprising:

toner particles comprising:

a binder resin; and a colorant, and a charge controlling agent which is at least located on a surface of the toner particles, wherein the toner composition has a spherical degree of from 0.96 to 0.99, and wherein the toner composition satisfies the following relationship:

$$10 \leqq M/T \leqq 1{,}000$$

wherein M represents a quantity of an element on a surface of the toner particles in units of % by weight, wherein the element is included only in the charge controlling agent, and is one of elements of second to fifth periodical elements in the long form periodic table other than carbon, oxygen and rare gas elements; and T represents a quantity of the element in the toner composition in units of % by weight, and the toner composition further satisfies the following relationship:

$$0.7 \leqq (Q/M1)/(Q/M2) \leqq 1.3$$

wherein Q/M1 represents a charge quantity of the toner composition in units of $\mu$C/g when the toner composition is mixed with a carrier coated with a silicone resin for 15 seconds and Q/M2 represents a charge quantity of the toner composition in units of $\mu$C/g when the toner composition is mixed with the carrier for 600 seconds.

2. The toner composition according to claim 1, wherein the ratio M/T is from 100 to 800.

3. The toner composition according to claim 2, wherein the spherical degree is from 0.975 to 0.985.

4. The toner composition according to claim 1, further having a volume average particle diameter (Dv) of from 2 $\mu$m to 8 $\mu$m and a number average particle diameter (Dn), wherein a ratio Dv/Dn is not greater than 1.2.

5. The toner composition according to claim 1, wherein the charge controlling agent is included in the toner composition in an amount of from 0.01% to 2.0% by weight based on total weight of the toner particles.

6. The toner composition according to claim 1, wherein the charge controlling agent comprises a compound selected from the group consisting of metal complexes of salicylic acid and salicylic acid derivatives and metal salts of salicylic acid and salicylic acid derivatives.

7. The toner composition according to claim 1, wherein the toner particles further comprise a wax, wherein the wax is dispersed in the toner particles while having an average dispersion diameter of from 0.2 $\mu$m to 2.0 $\mu$m.

8. The toner composition according to claim 1, wherein the binder resin comprises a polyester resin in a largest amount, and wherein soluble components of the binder resin having a molecular weight distribution such that a peak is observed in a range of from 1,000 to 30,000 and a fraction having a molecular weight not less than 30,000 is included in the binder resin in an amount of from 1% to 10% by weight.

9. The toner composition according to claim 1, wherein the toner particles are prepared by a method selected from the group consisting of:

a first method comprising:

kneading the binder resin and the colorant upon application of heat to prepare a mixture;

pulverizing the mixture to prepare a powdery mixture;

classifying the powdery mixture to prepare raw toner particles; and applying at least one of heat or a mechanical impulse force to the raw toner particles to prepare the toner particles, wherein the toner particles have a spherical degree of from 0.96 to 0.99;

a second method comprising:

suspension-polymerizing one or more monomers, which optionally includes the colorant, in an aqueous liquid to prepare the toner particles;

a third method comprising:

dissolving the binder resin in an organic solvent to prepare a solution of the binder resin;

dispersing the solution and the colorant in an aqueous liquid to prepare a dispersion of the binder resin and the colorant; and drying the dispersion of the binder resin and the colorant to prepare the toner particles;

a fourth method comprising:

dispersing the binder resin in an organic solvent to prepare an organic solvent dispersion of the binder resin;

dispersing the organic solvent dispersion and the colorant in an aqueous liquid to prepare an aqueous dispersion of the binder resin and the colorant; and drying the aqueous dispersion to prepare the toner particles;

a fifth method comprising:

reacting a prepolymer with a compound in an organic solvent to prepare a solution of the binder resin;

dispersing the solution and the colorant in an aqueous liquid to prepare an aqueous dispersion of the binder resin and the colorant; and drying the aqueous dispersion to prepare the toner particles;

a sixth method comprising:

reacting a prepolymer with a compound in an organic solvent to prepare an organic solvent dispersion of the binder resin;

dispersing the organic solvent dispersion and the colorant in an aqueous liquid to prepare an aqueous dispersion of the binder resin and the colorant; and drying the aqueous dispersion to prepare the toner particles; and a seventh method comprising:

reacting a prepolymer with a compound in an aqueous liquid comprising the colorant to prepare an aqueous dispersion of the binder resin and the colorant; and drying the aqueous dispersion to prepare the toner particles.

10. The toner composition according to claim 1, wherein the binder resin comprises a polyester resin.

11. The toner composition according to claim 10, wherein the polyester resin comprises a urea bonding.

12. The toner composition according to claim 1, wherein the spherical degree is from 0.975 to 0.985.

* * * * *